US010948939B2

(12) United States Patent
Morita

(10) Patent No.: US 10,948,939 B2
(45) Date of Patent: Mar. 16, 2021

(54) DISPLAY DRIVER, CIRCUIT DEVICE, ELECTRO-OPTICAL DEVICE, AND ELECTRONIC APPARATUS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 183 days.

(21) Appl. No.: 16/257,218

(22) Filed: Jan. 25, 2019

(65) Prior Publication Data

US 2019/0235561 A1 Aug. 1, 2019

(30) Foreign Application Priority Data

Jan. 26, 2018 (JP) ..... JP2018-011416

(51) Int. Cl.

| | |
|---|---|
| ***G05F 3/26*** | (2006.01) |
| ***G09G 3/20*** | (2006.01) |
| ***G09G 3/3225*** | (2016.01) |
| ***G09G 3/36*** | (2006.01) |

(52) U.S. Cl.

CPC ..... *G05F 3/262* (2013.01); *G09G 3/2007* (2013.01); *G09G 3/3225* (2013.01); *G09G 3/3696* (2013.01); *G09G 2310/027* (2013.01); *G09G 2310/0291* (2013.01); *G09G 2320/0252* (2013.01); *G09G 2330/021* (2013.01); *G09G 2330/028* (2013.01)

(58) Field of Classification Search

CPC .... G05F 3/262; G09G 3/3696; G09G 3/3225; G09G 3/2007; G09G 2320/0252; G09G 2330/021; G09G 2330/028; G09G 2310/027; G09G 2310/0291

See application file for complete search history.

(56) References Cited

U.S. PATENT DOCUMENTS

| | | | | |
|---|---|---|---|---|
| 2003/0006746 | A1 | 1/2003 | Nishimura | |
| 2003/0151578 | A1* | 8/2003 | Morita | G09G 3/2011 345/89 |
| 2007/0109038 | A1* | 5/2007 | Ogawa | G05F 3/205 327/540 |
| 2016/0111035 | A1 | 4/2016 | Morita | |

FOREIGN PATENT DOCUMENTS

| | | | |
|---|---|---|---|
| JP | 2002-328732 | A | 11/2002 |
| JP | 2016-80807 | A | 5/2016 |

* cited by examiner

*Primary Examiner* — Alexander Eisen
*Assistant Examiner* — Kebede T Teshome
(74) *Attorney, Agent, or Firm* — Oliff PLC

(57) ABSTRACT

A display driver includes a driving circuit including an amplifier circuit and configured to cause the amplifier circuit to output a data voltage corresponding to display data, a reference voltage generation circuit configured to generate a reference voltage supplied to a reference current source of the amplifier circuit and output the reference voltage to an output node, and a setting circuit configured to set a voltage of the output node of the reference voltage generation circuit. The setting circuit includes a capacitor having one end connected with the output node, and a control circuit configured to control a voltage of another end of the capacitor based on an enable signal to change a voltage of the output node from a first voltage at which a reference current flowing in the reference current source is off, toward the reference voltage.

9 Claims, 15 Drawing Sheets

DISPLAY DRIVER, CIRCUIT DEVICE, ELECTRO-OPTICAL DEVICE, AND ELECTRONIC APPARATUS

BACKGROUND

1. Technical Field

The invention relates to a display driver, a circuit device, an electro-optical device, an electronic apparatus, and the like.

2. Related Art

A display driver for an electro-optical panel uses an amplifier circuit included in a driving circuit to drive the electro-optical panel. The amplifier circuit is provided with a reference current source, and a reference current flowing in the reference current source is used to operate the amplifier circuit. The display driver is provided with a reference voltage generation circuit for generating a reference voltage for generating the reference current. JP-A-2016-80807 discloses a display driver, and JP-A-2002-328732 discloses a reference voltage generation circuit.

In order to save power for the amplifier circuit, it is desirable that on/off of a reference voltage output of the reference voltage generation circuit can be controlled. By controlling on/off of the reference voltage output, on/off of the reference current flowing in the amplifier circuit can be controlled to save power. However, when turning on/off the reference voltage output by the reference voltage generation circuit takes a long time, a driving duration of the display driver is shortened, thus achieving high speed driving of the display driver becomes difficult. In this regard, JP-A-2002-328732 discloses a technique for speeding up a startup of the reference voltage generation circuit using a capacitor. However, JP-A-2002-328732 only speeds up a startup of the reference voltage generation circuit at power-up, and does not describe a technique for controlling on/off of the reference voltage output.

SUMMARY

According to some aspects of the invention, a display driver, a circuit device, an electro-optical device, an electronic apparatus, and the like capable of achieving speed-up of turning on/off of a reference voltage output of a reference voltage generation circuit can be provided.

An aspect of the invention relates to a display driver that includes a driving circuit including an amplifier circuit and configured to cause the amplifier circuit to output a data voltage corresponding to display data, a reference voltage generation circuit configured to generate a reference voltage supplied to a reference current source of the amplifier circuit and output the reference voltage to an output node, and a setting circuit configured to set a voltage of the output node of the reference voltage generation circuit, wherein the setting circuit includes a capacitor having one end connected with the output node, and a control circuit configured to control a voltage of another end of the capacitor based on an enable signal, to change a voltage of the output node from a first voltage at which a reference current flowing in the reference current source is off, toward the reference voltage side.

According to an aspect of the invention, since the voltage of the output node of the reference voltage generation circuit is set to the first voltage, the reference voltage output of the reference voltage generation circuit turns off, and thus the reference current of the amplifier circuit can be turned off. Additionally, in response to the reference voltage output being switched from off to on, the control circuit uses the capacitor to change the voltage of the output node from the first voltage toward the reference voltage side. Accordingly, the voltage of the output node approaches the reference voltage being a target voltage, and the reference voltage output can be switched from off to on at high speed. In this way, according to the aspect of the invention, since the capacitor is used to switch on/off of the reference voltage output, a display driver capable of speeding up of turning on/off of the reference voltage output of the reference voltage generation circuit can be achieved.

In addition, according to an aspect of the invention, the control circuit may be configured to set one end and another end of the capacitor to the first voltage when the enable signal is inactive, and set another end of the capacitor to a second voltage different from the first voltage when the enable signal is active.

In this way, in response to the enable signal turning to active from inactive, a voltage of the output node to which the one end of the capacitor is connected changes toward the reference voltage side, and thus the reference voltage output can be switched from off to on.

Additionally, according to an aspect of the invention, the first voltage is a source voltage of a first power source, and the second voltage is a source voltage of a second power source, the control circuit includes a switch having one end connected with the output node, and another end connected with a node of the first power source, and an inverter configured to output an inverted signal of the enable signal to another end of the capacitor, and when the enable signal is inactive, the switch may be turned on and the inverter may output a signal with a voltage level of the first power source to another end of the capacitor, and when the enable signal is active, the switch may be turned off, and the inverter may output a signal with a voltage level of the second power source to another end of the capacitor.

In this way, in response to the enable signal turning inactive, the switch turns on, thus the output node of the reference voltage generation circuit is set to the voltage level of the first power source. Additionally, in response to the enable signal turning active from inactive, the signal with the voltage level of the second power source is outputted to another end of the capacitor, thus it is possible to change the voltage of the output node from the voltage level of the first power source toward the reference voltage side.

Additionally, according to an aspect of the invention, the first voltage is a source voltage of a first power source, and the second voltage is a source voltage of a second power source, and the reference voltage generation circuit may include a current source circuit, having one end connected with the output node, and another end connected with a node of the second power source, configured to make a current set based on a current setting signal flow between the output node and a node of the second power source, and a current voltage conversion circuit, having one end connected with the output node, and another end connected with a node of the first power source, configured to convert the current made to flow by the current source circuit to the reference voltage.

In this way, the current source circuit makes a current flow between the output node and the node of the second power source, and the current voltage conversion circuit converts the current to a voltage, thus the reference voltage can be generated.

Additionally, an aspect of the invention relates to a circuit device that includes a driving circuit including an amplifier circuit and configured to cause the amplifier circuit to output a data voltage corresponding to display data, a reference voltage generation circuit configured to generate a reference voltage supplied to a reference current source of the amplifier circuit and output the reference voltage to an output node, and a setting circuit configured to set a voltage of the output node of the reference voltage generation circuit, wherein the setting circuit includes a first to an m-th capacitors in each of which one end is connected with the output node, and a control circuit configured to control a voltage of another end of each of the first to the m-th capacitors based on an enable signal to change a voltage of the output node from a first voltage at which a reference current flowing in the reference current source off, toward the reference voltage side, the reference voltage generation circuit includes a current source circuit, having one end connected with the output node, and another end connected with a node of a second power source, configured to make a current set based on a current setting signal flow between the output node and a node of the second power source, and a current voltage conversion circuit, having one end connected with the output node, and another end connected with a node of a first power source, configured to convert the current made to flow by the current source circuit to the reference voltage, and the control circuit is configured to control a voltage of another end of each of one or more capacitors selected based on the current setting signal among the first to the m-th capacitors.

According to an aspect of the invention, the current source circuit of the reference voltage generation circuit makes the current according to the current setting signal flow between the output node and the node of the second power source, and the current voltage conversion circuit converts the current to the voltage, thus the reference voltage is generated. In addition, since the control circuit controls the voltage of the other end of each of the first to the m-th capacitors, the voltage of the output node changes from the first voltage at which the reference current is off, toward the reference voltage side, and thus the reference voltage output can be turned on/off at high speed. Further, the control circuit controls the voltage of the other end of each of one or more capacitors selected based on the current setting signal among the first to the m-th capacitors. Thus, in response to the reference voltage output of the reference voltage generation circuit being switched from off to on, optimal voltage control for bringing the voltage of the output node closer to the reference voltage being the target voltage can be achieved.

In addition, according to an aspect of the invention, the driving circuit may be configured to, drive a data line with higher driving capability than driving capability of the amplifier circuit in a first driving duration, and cause the amplifier circuit to output the data voltage to the data line in a second driving duration following the first driving duration, and the setting circuit may be configured to, set a voltage of the output node to the first voltage in the first driving duration, and set a voltage of the output node to the reference voltage in the second driving duration.

In this way, in the first driving duration, the data line is driven with the higher driving capability than the driving capability of the amplifier circuit, thus it is possible to bring a voltage of the data line closer to the data voltage being the target voltage. Additionally, since in the first driving duration, the voltage of the output node of the reference voltage generation circuit becomes the first voltage, the reference current of the amplifier circuit can be turned off to save power. Further, since in the second driving duration, the voltage of the output node of the reference voltage generation circuit is set to the reference voltage, the reference current flows in the amplifier circuit, thus the amplifier circuit can be used to output the data voltage.

Additionally, according to an aspect of the invention, the amplifier circuit may include the reference current source, a differential pair circuit connected with the reference current source and including a differential pair transistor, and a current mirror circuit connected with the differential pair circuit.

In this way, in response to the output node of the reference voltage generation circuit being set to the first voltage, a current flowing in the reference current source of the amplifier circuit is turned off, and thus operation of the amplifier circuit can be turned off.

Additionally, another aspect of the invention relates to a circuit device that includes a reference voltage generation circuit configured to generate a reference voltage and output the reference voltage to an output node, and a setting circuit configured to set a voltage of the output node of the reference voltage generation circuit, wherein the setting circuit includes a capacitor having one end connected with the output node, and a control circuit configured to control a voltage of another end of the capacitor based on an enable signal to change a voltage of the output node from a first voltage toward the reference voltage side.

According to another aspect of the invention, since the voltage of the output node of the reference voltage generation circuit is set to the first voltage, the reference voltage output of the reference voltage generation circuit can be turned off. Additionally, in response to the reference voltage output being switched from off to on, the control circuit uses the capacitor to change the voltage of the output node from the first voltage toward the reference voltage side. Accordingly, the voltage of the output node approaches the reference voltage being a target voltage, and the reference voltage output can be switched from off to on at high speed. In this way, according to the aspect of the invention, since the capacitor is used to switch on/off of the reference voltage output, a circuit device capable of speeding up of turning on/off of the reference voltage output of the reference voltage generation circuit can be achieved.

Further, another aspect of the invention relates to an electro-optical device including the display driver described above, and an electro-optical panel that is driven by the display driver.

Further, another aspect of the invention relates to an electronic apparatus including the display driver described in any one of the descriptions above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some exemplary embodiments of the invention will be described in detail hereinafter. Note that the exemplary embodiments described hereinafter are not intended to limit the content of the invention as set forth in the claims, and not all of the configurations described in the exemplary embodiments are absolutely required to address the issues described in the invention.

1. Display Driver, Electro-Optical Device

Figure 1:
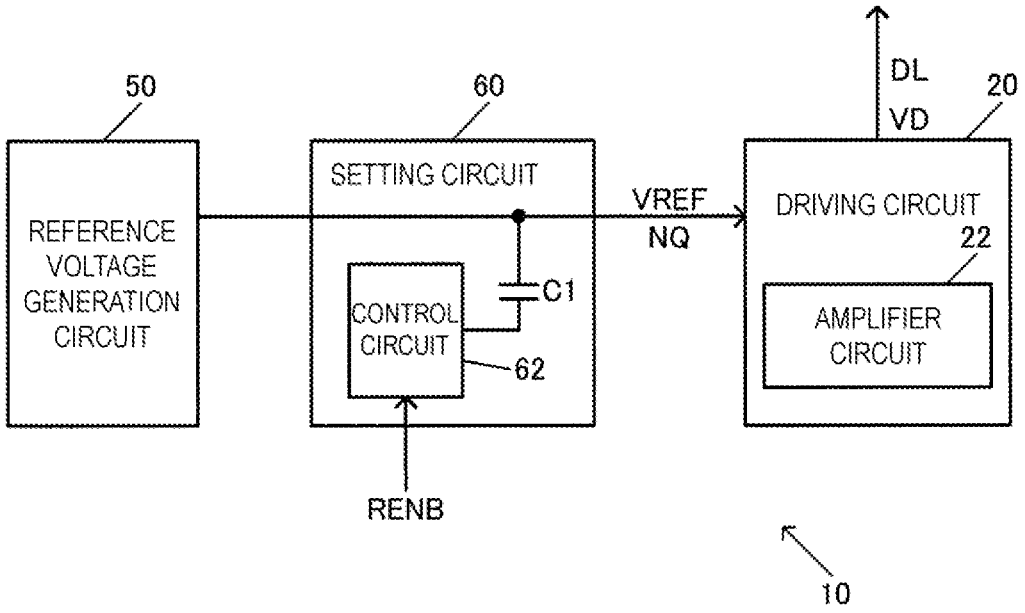
FIG. 1 illustrates an example of a configuration of a display driver in an exemplary embodiment.

FIG. 1 illustrates an example of a configuration of a display driver 10 in the exemplary embodiment. The display driver 10 includes a driving circuit 20, a reference voltage generation circuit 50, and a setting circuit 60.

The driving circuit 20 includes an amplifier circuit 22, and causes the amplifier circuit 22 to output a data voltage VD corresponding to display data. For example, the data voltage VD obtained by applying D/A conversion on the display data is outputted to a data line DL by the amplifier circuit 22. The driving circuit 20 drives an electro-optical panel 200 in FIG. 2. The amplifier circuit 22 may be an amplifying circuit with a voltage follower connection, or may be an inverted amplifying circuit.

The reference voltage generation circuit 50 generates a reference voltage VREF. Specifically, the reference voltage generation circuit 50 generates the reference voltage VREF supplied to a reference current source of the amplifier circuit 22, and outputs the generated reference voltage VREF to an output node NQ. The reference current source of the amplifier circuit 22 will be described later. The setting circuit 60 sets a voltage of an output node of the reference voltage generation circuit 50.

Specifically, the setting circuit 60 includes a capacitor C1 and a control circuit 62. One end of the capacitor C1 is connected with the output node NQ. Another end of the capacitor C1 is connected with the control circuit 62. The control circuit 62 controls a voltage of the other end of the capacitor C1 based on an enable signal RENB of an output of the reference voltage VREF. For example, the control circuit 62 changes the voltage of the other end of the capacitor C1 to a first voltage from a second voltage, or changes the voltage from the first voltage to the second voltage. In addition, the control circuit 62 controls the voltage of the other end of the capacitor C1 based on the enable signal RENB to change a voltage of the output node NQ of the reference voltage generation circuit 50 from the first voltage at which a reference current flowing in a reference current source of the amplifier circuit 22 is off, toward the reference voltage VREF. Alternatively, change the voltage from the reference voltage VREF toward the first voltage side is made. Here, the change from the first voltage toward the reference voltage VREF means changing the voltage of the output node NQ with the reference voltage VREF as a target voltage. For example, when the voltage of the reference voltage VREF is lower than the first voltage, the control circuit 62 changes the voltage of the output node NQ from the first voltage to a voltage lower than the first voltage, by controlling the voltage of the other end of the capacitor C1. On the other hand, when the voltage of the reference voltage VREF is higher than the first voltage, the control circuit 62 changes the voltage of the output node NQ from the first voltage to a voltage higher than the first voltage, by controlling the voltage of the other end of the capacitor C1.

Specifically, the control circuit 62, when the enable signal RENB is inactive, sets the one end and the other end of the capacitor C1 to the first voltage. For example, the one end and the other end of the capacitor C1 are set to an identical voltage. Additionally, the control circuit 62, when the enable signal RENB is active, sets the other end of the capacitor C1 to the second voltage different from the first voltage. An inactive level of the enable signal RENB is, for example, an L level, and an active level is, for example, an H level. That is, the control circuit 62, in response to the enable signal RENB changing from inactive to active, switches the voltage of the other end of the capacitor C1 from the first voltage to the second voltage. When the first and the second voltages are VDD, and VSS, respectively, the control circuit 62 switches the voltage of the other end of the capacitor C1 from VDD to VSS. When the first and the second voltages are VSS, and VDD, respectively, the control circuit 62 switches the voltage of the other end of the capacitor C1 from VSS to VDD. In this way, charge redistribution between the capacitor C1 and parasitic capacitance of the output node NQ changes the voltage of the output node NQ being the one end of the capacitor C1 at high speed, thus the voltage of the output node NQ can be changed from the first voltage toward the reference voltage VREF at high speed. Additionally, after the voltage of the output node NQ reached an attainment voltage by the capacitor C1, the reference voltage generation circuit 50 changes the voltage of the output node NQ from the attainment voltage to the reference voltage VREF. Here, the parasitic capacitance of the output node NQ is gate capacitance of a transistor configuring the reference current source of the amplifier circuit 22, wiring capacitance of a signal line, or the like. VSS is, for example, a power source of GND being grounding potential.

As described above, in the exemplary embodiment, by controlling the voltage of the other end of the capacitor C1, the voltage of the output node NQ is changed from the first voltage at which a reference current of the reference current source is off, toward the reference voltage VREF. Accordingly, the reference voltage output of the reference voltage generation circuit 50 can be switched from off to on at high speed, thus high speed driving of the display driver 10 can be achieved. Turning the reference voltage output off means setting the voltage of the output node NQ to the first voltage at which the reference current of the reference current source is off. Turning the reference voltage output on means setting the voltage of the output node NQ to the reference voltage VREF.

When the setting circuit 60 sets the voltage of the output node NQ to the first voltage being VDD or VSS, for example, the reference current flowing in the reference current source of the amplifier circuit 22 can be turned off. Accordingly, power can be saved in the driving circuit 20. Subsequently, the setting circuit 60 uses the capacitor C1 to change the voltage of the output node NQ from the first voltage being an off voltage of the reference current toward the reference voltage VREF, to make the reference current flow in the reference current source of the amplifier circuit 22. This makes it possible to operate the amplifier circuit 22 to drive the data line DL.

In the exemplary embodiment, the charge redistribution between the parasitic capacitance using the capacitor C1 changes the voltage of the output node NQ of the reference voltage generation circuit 50. Accordingly, the voltage of the output node NQ can be changed from the first voltage toward the reference voltage VREF at high speed, and thus the reference current of the amplifier circuit 22 can be changed from an off state to an on state, to drive the data line DL using the amplifier circuit 22. That is, the reference voltage generation circuit 50 only needs to change the voltage of the output node NQ from the attainment voltage by the capacitor C1 to the reference voltage VREF. Accordingly, compared to a case in which only the reference voltage generation circuit 50 is used to change the voltage from the first voltage to the reference voltage VREF, the voltage of the output node NQ can be made to transit to the reference voltage VREF at high speed, to switch the reference current from off to on at high speed. Thus, a situation in which switching the reference current from off to on takes a long time shortens the driving duration of the driving circuit 20 can be prevented, to secure long driving time as a result, and thus high speed driving of the display driver 10 can be achieved.

Figure 2:
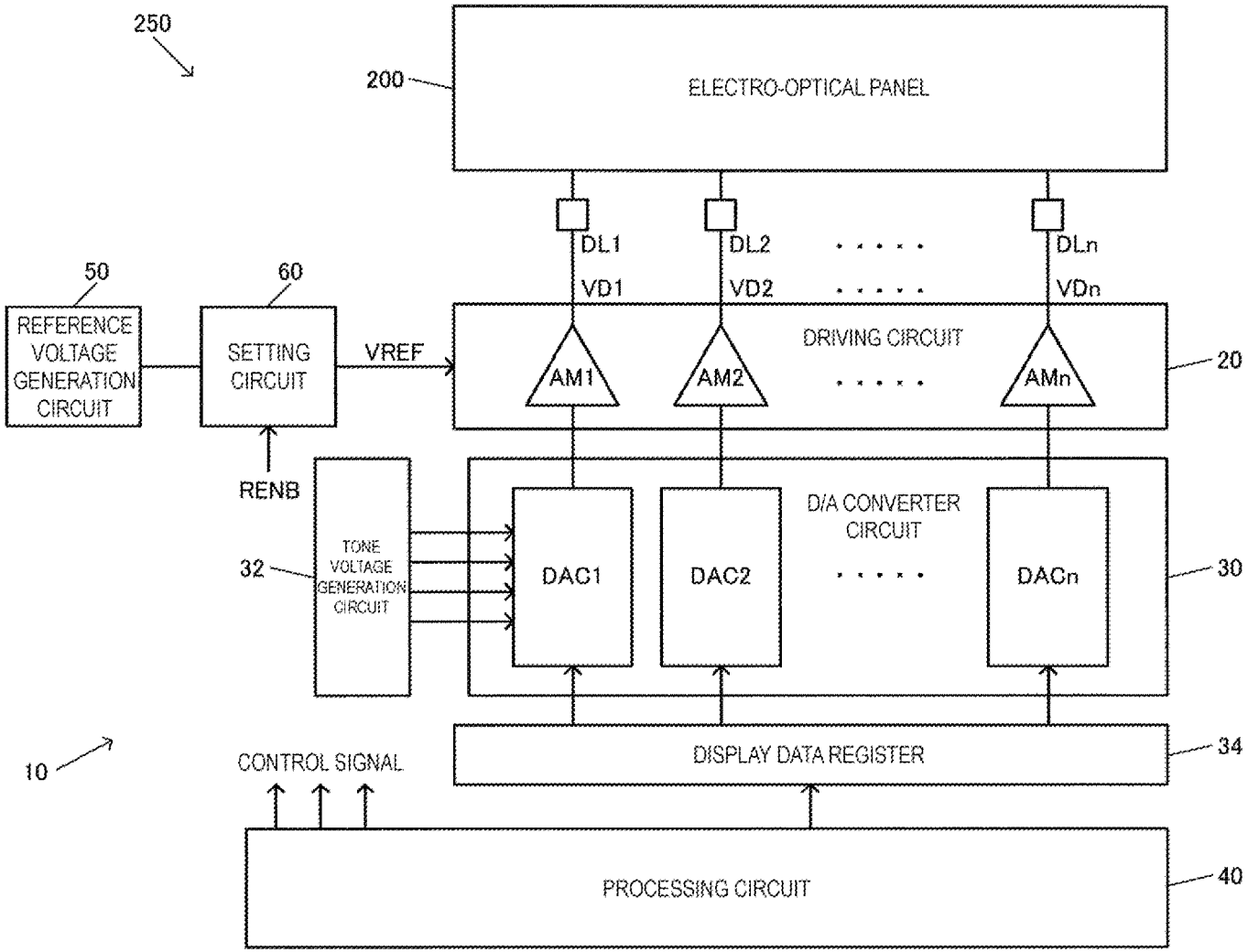
FIG. 2 illustrates a detailed example of a configuration of the display driver and an electro-optical device in the exemplary embodiment.

FIG. 2 illustrates a detailed example of a configuration of the display driver 10 and an electro-optical device 250. The electro-optical device 250 includes the display driver 10, and an electro-optical panel 200 driven by the display driver 10. The display driver 10 is, for example, a data driver, and drives a data line of the electro-optical panel 200. The display driver 10 may include a scanning driver for driving a scanning line. The data line and the scanning line are a source line and a gate line, respectively, for example.

The electro-optical panel 200 is a panel for displaying images, and can be implemented with a liquid crystal panel, an organic EL panel, or the like, for example. An active-matrix panel using switching elements such as thin film transistors (TFTs) can be employed as the liquid crystal panel. Specifically, a display panel as the electro-optical panel 200 includes a plurality of pixels. The plurality of pixels is disposed in a matrix, for example. The electro-optical panel 200 also includes a plurality of data lines and a plurality of scanning lines laid in a direction intersecting with the plurality of data lines. Each pixel among the plurality of pixels is disposed at a region where each data line and each scanning line intersect. In an active-matrix panel, a switching element such as a thin film transistor is disposed at each pixel region. The electro-optical panel 200 realizes display operations by changing the optical properties of electro-optical elements at the pixel regions. The electro-optical element is a liquid crystal element, an EL element, or the like. Note that in an organic EL panel, pixel circuits for driving the EL elements with current are disposed at each pixel region.

The display driver 10 includes the driving circuit 20, a D/A converter circuit 30, a tone voltage generation circuit 32, a display data register 34, a processing circuit 40, the reference voltage generation circuit 50, and the setting circuit 60. Note that the display driver 10 is not limited to the configuration in FIG. 2. Many modified examples are possible, such as omitting some of these constituent elements, adding other constituent elements, and the like.

The driving circuit 20 outputs data voltages VD1 to VDn (n is an integer equal to or greater than 2) corresponding to display data to data lines DL1 to DLn, respectively, to drive the electro-optical panel 200. The driving circuit 20 includes a plurality of amplifier circuits AM1 to AMn. These amplifier circuits AM1 to AMn output the data voltages VD1 to VDn to the data lines DL1 to DLn, respectively. Note that, the electro-optical panel 200 may be provided with a switching element for demultiplexing, for the amplifier circuits AM1 to AMn to output data voltages corresponding to a plurality of source lines of the electro-optical panel 200, respectively, in a time-shared manner.

The processing circuit 40 performs various control processes such as display control of the electro-optical panel 200, control of each circuit in the display driver 10, an interface process with an external device, and the like. The processing circuit 40 can be implemented by automatic placement and routing such as a gate array. The processing circuit 40 performs the above control processes by outputting a plurality of control signals. For example, the enable signal RENB inputted to the setting circuit 60 is outputted as a control signal from the processing circuit 40.

The display data register 34 latches display data from the processing circuit 40. The tone voltage generation circuit 32 being a gamma voltage circuit generates a plurality of tone voltages and supplies them to the D/A converter circuit 30. The D/A converter circuit 30 includes a plurality of D/A converters DAC1 to DACn. In addition, the D/A converter circuit 30 selects a tone voltage corresponding to the display data from the display data register 34, among the plurality of the tone voltages from the tone voltage generation circuit 32, and outputs it to the driving circuit 20. The driving circuit 20 outputs the selected tone voltage as a data voltage to each data line.

2. Reference Voltage Generation Circuit, Setting Circuit

Figure 3:
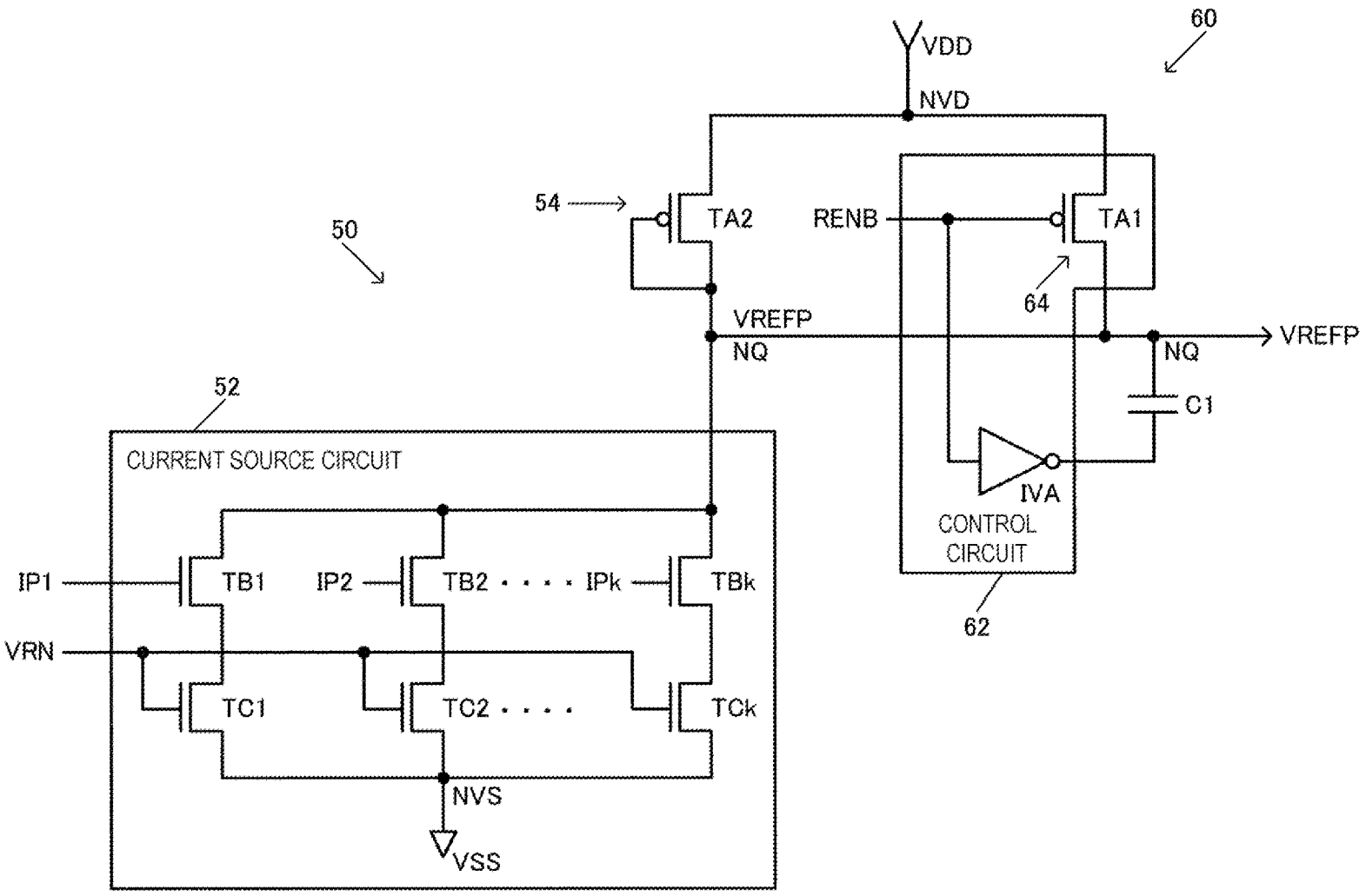
FIG. 3 illustrates examples of configurations of a reference voltage generation circuit and a setting circuit.

FIG. 3 illustrates an example of a configuration of the reference voltage generation circuit 50 and the setting circuit 60. The reference voltage generation circuit 50 generates a reference voltage VREFP supplied to the reference current source, and outputs it to the output node NQ. The setting circuit 60 includes the capacitor C1 having the one end connected with the output node NQ, and the control circuit 62. The control circuit 62, by controlling the voltage of the other end of the capacitor C1, changes the voltage of the output node NQ from the first voltage at which the reference current is off, toward the reference voltage VREFP. Specifically, the control circuit 62, when the enable signal RENB is at the L level, sets the one end and the other end of the capacitor C1 to the first voltage, and when the enable signal RENB is at the H level, sets the one end and the other end of the capacitor C1 to the second voltage. In FIG. 3, the first voltage is a source voltage for VDD, that is, a voltage at the H level (high level). The second voltage is a source voltage for VSS, that is, a voltage at the L level (low level). In FIG. 3, VDD is a first power source and VSS is a second power source.

Figure 5:
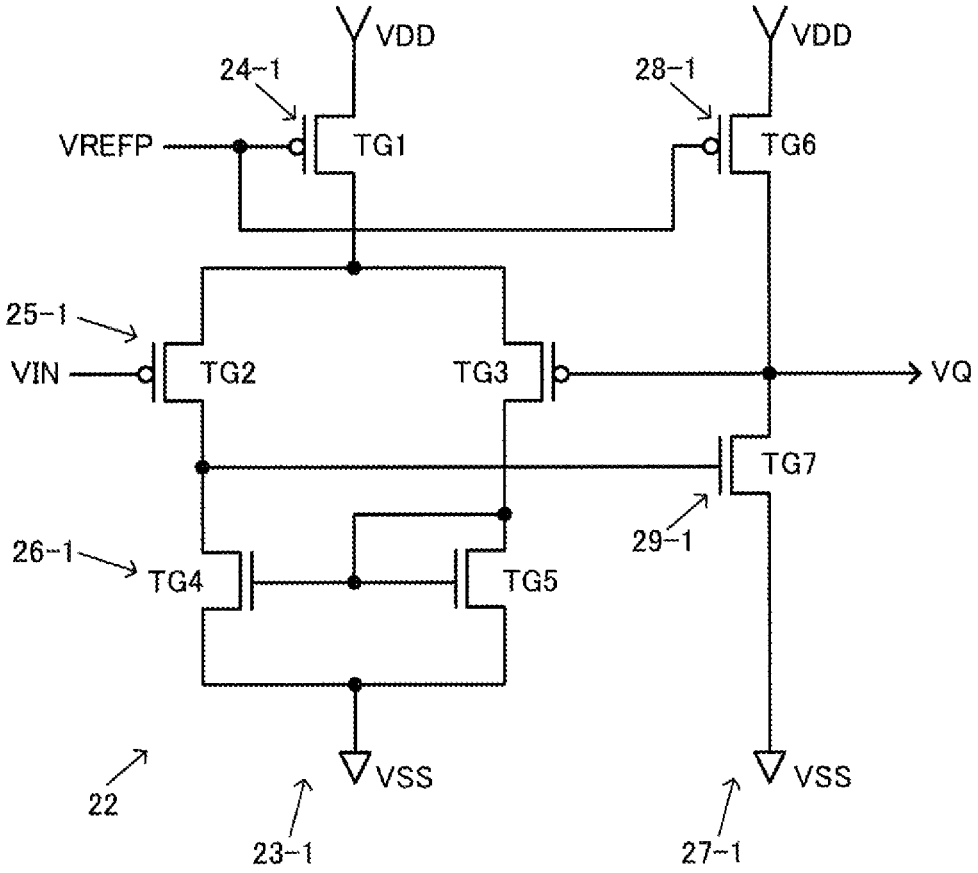
FIG. 5 illustrates an example of a configuration of an amplifier circuit.
Figure 7:
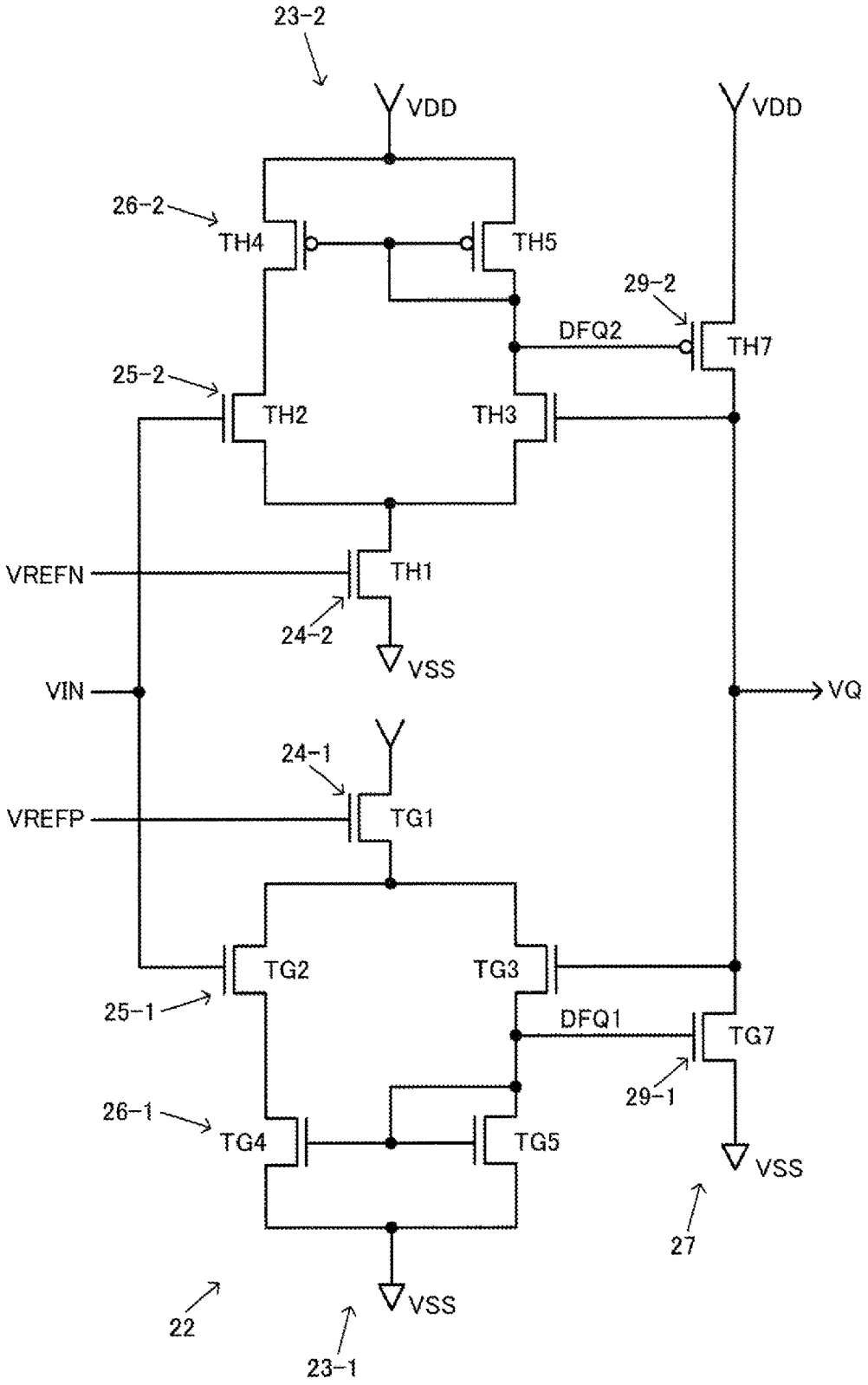
FIG. 7 illustrates an example of a configuration of an amplifier circuit.

Accordingly, when the enable signal RENB is at the L level being an inactive level, the one end and the other end of the capacitor C1 are set to the H level being the first voltage. This sets the output node NQ to the H level, and turns the reference current flowing in the reference current source of the amplifier circuit 22 off. For example, as illustrated in FIG. 5 and FIG. 7 described later, reference current sources 24-1 and 28-1 of the amplifier circuit 22 are configured with P-type transistors TG 1 and TG 6, respectively, and setting respective gates of the P-type transistors TG 1 and TG 6 to the H level turns the reference currents flowing in the reference current sources 24-1 and 28-1 off respectively. Additionally, the control circuit 62, in response to the enable signal RENB changing from the L level being the inactive level to the H level being the active level, changes the voltage of the other end of the capacitor C1 from the H level being the first voltage to the L level being the second voltage. Accordingly, due to capacity coupling of the capacitor C1, the voltage of the output node NQ changes from the H level toward the reference voltage VREFP. That is, the voltage changes from the H level to a voltage lower than the H level. Accordingly, the voltage of the output node NQ changes from the H level toward the reference voltage VREFP at high speed, and the reference voltage output of the reference voltage generation circuit 50 can be switched from off to on at high speed. That is, the reference voltage generation circuit 50 only needs to change the voltage of the output node NQ from the attainment voltage by the capacitor C1 to the reference voltage VREFP. Accordingly, compared to a case in which the single reference voltage generation circuit 50 is used to change the voltage, the voltage of the output node NQ can be changed to the reference voltage VREFP at high speed. In addition, the reference voltage VREFP is supplied to the P-type transistors TG 1 and TG 6 configuring the respective reference current sources 24-1 and 28-1 of the amplifier circuit 22, and thus the reference current flows in the amplifier circuit 22.

Specifically, in FIG. 3, the control circuit 62 includes a switch 64 having one end connected with the output node NQ and another end connected with a node NVD of VDD being the first power source, and an inverter IVA for outputting an inverted signal of the enable signal RENB to the other end of the capacitor C1. In FIG. 3, the switch 64 is configured with a P-type transistor TA1 having a source connected with the node NVD of VDD, and a drain connected with the output node NQ. A gate of the transistor TA1 is supplied with the enable signal RENB.

Additionally, when the enable signal RENB is at the L level, the switch 64 turns on, and the inverter IVA outputs a signal with a voltage level of VDD being the first power source to the other end of the capacitor C1. That is, since the gate of the P-type transistor TA1 configuring the switch 64 is inputted with the enable signal RENB at the L level, the transistor TA1 turns on, and the output node NQ is set to the H level being the voltage level of VDD. Further, the inverter IVA outputs a signal at the H level being the voltage level of VDD to the other end of the capacitor C1. Accordingly, the one end and the other end of the capacitor C1 are set to the H level being the first voltage.

On the other hand, when the enable signal RENB is at the H level, the switch 64 turns off, and the inverter IVA outputs a signal with a voltage level of VSS being the second power source to the other end of the capacitor C1. That is, since the gate of the P-type transistor TA1 configuring the switch 64 is inputted with the enable signal RENB at the H level, the transistor TA1 turns off. For example, when the enable signal RENB is at the L level, the transistor TA1 sets the output node NQ to the H level, but in response to the enable signal RENB being at the H level, the transistor TA1 does not set the H level. Further, the inverter IVA outputs a signal at the L level being the voltage level of VSS to the other end of the capacitor C1. Accordingly, the voltage of the other end of the capacitor C1 having the one end and the other end set to the H level changes from the H level to the L level. Accordingly, due to the charge redistribution between capacitance of the capacitor C1 and the parasitic capacitance of the output node NQ, the voltage of the output node NQ changes from the H level toward the reference voltage VREFP. Accordingly, the reference voltage output of the reference voltage generation circuit 50 can be switched from off to on at high speed to switch the reference current flowing in the reference current source of the amplifier circuit 22 from off to on at high speed.

That is, when the enable signal RENB is at the L level, the voltage of the output node NQ is at the H level, thus the reference current of the amplifier circuit 22 turns off and power is saved for the amplifier circuit 22. Additionally, in response to the enable signal RENB changing from the L level to the H level, the other end of the capacitor C1 having the one end and the other end having been set to the H level changes from the H level to the L level. Accordingly, due to the capacity coupling of the capacitor C1, the voltage of the output node NQ can be changed from the H level to the reference voltage VREFP at high speed to turn the reference current of the amplifier circuit 22 on, and thus operation of the amplifier circuit 22 can be turned on.

On the other hand, in response to the enable signal RENB changing from the H level to the L level, the inverter IVA changes the other end of the capacitor C1 from the L level to the H level. Accordingly, due to the capacity coupling of the capacitor C1, the voltage of the output node NQ changes toward the H level at high speed, and thus the reference current can be turned off at high speed. This makes it possible to turn the operation of the amplifier circuit 22 off at high speed to save power.

In this way, according to the configuration in FIG. 3, the reference voltage output of the reference voltage generation circuit 50 can be switched on/off at high speed, and the reference current of the amplifier circuit 22 can be switched on/off at high speed. Thus, a situation in which switching the reference current from off to on takes a long time shortens the driving duration of the driving circuit 20 can be prevented, to secure long driving time, and thus high speed driving of the display driver 10 is enabled. Further, since the reference current can be turned off at high speed, power saving is achieved for the driving circuit 20, and both the high speed driving and the power saving can be achieved in a compatible manner.

Additionally, the reference voltage generation circuit 50 includes a current source circuit 52 and a current voltage conversion circuit 54. In the current source circuit 52, one end is connected with the output node NQ, and another end is connected with a node NVS of VSS being the second power source. In addition, the current source circuit 52 makes a current set based on current setting signals IP1 to IPk (k is an integer equal to or greater than 2) flow between the output node NQ and the node NVS of VSS. Additionally, the current voltage conversion circuit 54 having one end connected with the output node NQ, and another end connected with the node NVD of VDD being the first power source, converts the current made to flow by the current source circuit 52 to the reference voltage VREFP.

Specifically, the current source circuit 52 is configured with a plurality of N-type transistors TB1 to TBk and a plurality of N-type transistors TC1 to TCk. Gates of the transistors TB1 to TBk are supplied with the current setting signals IP1 to IPk, respectively. Each of the transistors TB1 to TBk functions as a switch to turn a current on/off. A gate of each of the transistors TC1 to TCk is supplied with a reference voltage VRN for the N-type transistor. Each of the transistors TC1 to TCk functions as a current source of the current source circuit 52. Accordingly, in the current source circuit 52, respective currents according to the current setting signals IP1 to IPk flow between the output node NQ and the node NVS.

Specifically, respective sizes (W/L) of the transistors TC2, TC3, TC4, . . . , TCk are set to two times, four times, eight times, . . . , $2^{k-1}$ times a size of the transistor TC1, respectively. That is, the respective sizes of the transistors TC1 to TCk are set in proportion to a power of 2. Accordingly, when the current setting signal IP1 is at the H level being the active level, and the other current setting signals IP2 to IPk are at the L level being the inactive level, a current flowing in the current source circuit 52 is set to minimum. On the other hand, when all the current setting signals IP1 to IPk are at the H level, the current flowing in the current source circuit 52 is set to maximum. Additionally, as the current flowing in the current source circuit 52 increases, the reference voltage VREFP decreases, and a voltage difference VDD-VREFP increases. In response to the voltage difference VDD-VREFP increasing, a reference current flowing in the amplifier circuit 22 increases, and driving capability of the amplifier circuit 22 is enhanced. Thus, in an inspection process and an adjustment process before product shipment of the display driver 10, in order to set the amplifier circuit 22 to desired driving capability, respective set values of the current setting signals IP1 to IPk are determined, and the determined set values are stored in a set value storage unit such as a fuse circuit or a non-volatile memory provided on the display driver 10.

The current voltage conversion circuit 54 is configured with a P-type transistor TA2 provided between the node NVD of VDD and the output node NQ. In the transistor TA2, a source is connected with the node NVD, and a gate and a drain are connected with the output node NQ. By using the transistor TA2 with the above-described diode connection, a current flowing in the current source circuit 52 can be converted to a voltage to generate the reference voltage VREFP.

For example, as a first comparative example of the exemplary embodiment, a circuit with a configuration in which the capacitor C1 and the inverter IVA in FIG. 3 are not provided is conceivable. In the first comparative example, when the enable signal RENB is at the L level, the transistor TA1 turns on, and the output node NQ is at the H level, thus the reference current of the amplifier circuit 22 turns off. Additionally, in response to the enable signal RENB changing from the L level to the H level, the transistor TA1 turns off, thus a current flowing in the current source circuit 52 causes the voltage of the output node NQ to gradually change from the H level to the reference voltage VREFP.

However, in the first comparative example, it takes a long time for the voltage of the output node NQ to change from the H level to the reference voltage VREFP. For example, a time constant of CR according to the parasitic capacitance of the output node NQ and on-resistance of a transistor in the current source circuit 52 causes the voltage of the output node NQ to gradually change from the H level to the reference voltage VREFP. Thus, it takes a long time for the reference current of the amplifier circuit 22 to turn from off to on, and this causes to shorten a driving duration of the driving circuit 20, thus achieving the high speed driving of the display driver 10 becomes difficult.

In this regard, according to the exemplary embodiment, in response to the enable signal RENB changing from the L level to the H level, due to the capacity coupling of the capacitor C1, the voltage of the output node NQ can be changed from the H level toward the reference voltage VREFP. Additionally, the reference voltage generation circuit 50 only needs to change the voltage of the output node NQ from the attainment voltage by the capacitor C1 to the reference voltage VREFP. Accordingly, also when the above-described time constant of CR is large, the reference current of the amplifier circuit 22 can be switched from off to on at high speed, thus the high speed driving of the display driver 10 can be achieved.

Further, as a second comparative example of the exemplary embodiment, a configuration in which an amplifier circuit with a voltage follower connection is provided at an output of the reference voltage generation circuit 50 is conceivable, for example. With the above-described amplifier circuit provided, the reference voltage output can be switched from off to on at high speed, and the reference current can be switched from off to on at high speed.

However, in the second comparative example, due to an offset voltage of the amplifier circuit with the voltage follower connection or the like, there is a problem that voltage precision of the reference voltage lowers. Additionally, there is another problem that an operating current of the amplifier circuit hinders power saving.

In this regard, according to the exemplary embodiment, since the capacitor C1 is used to speed up switching on/off of the reference voltage output, the problems in the above described second comparative example can be prevented from occurring. Accordingly, the power saving of the display driver 10, and the high speed driving of the display driver 10 by switching on/off of the reference voltage output at high speed can be achieved in a compatible manner.

Figure 4:
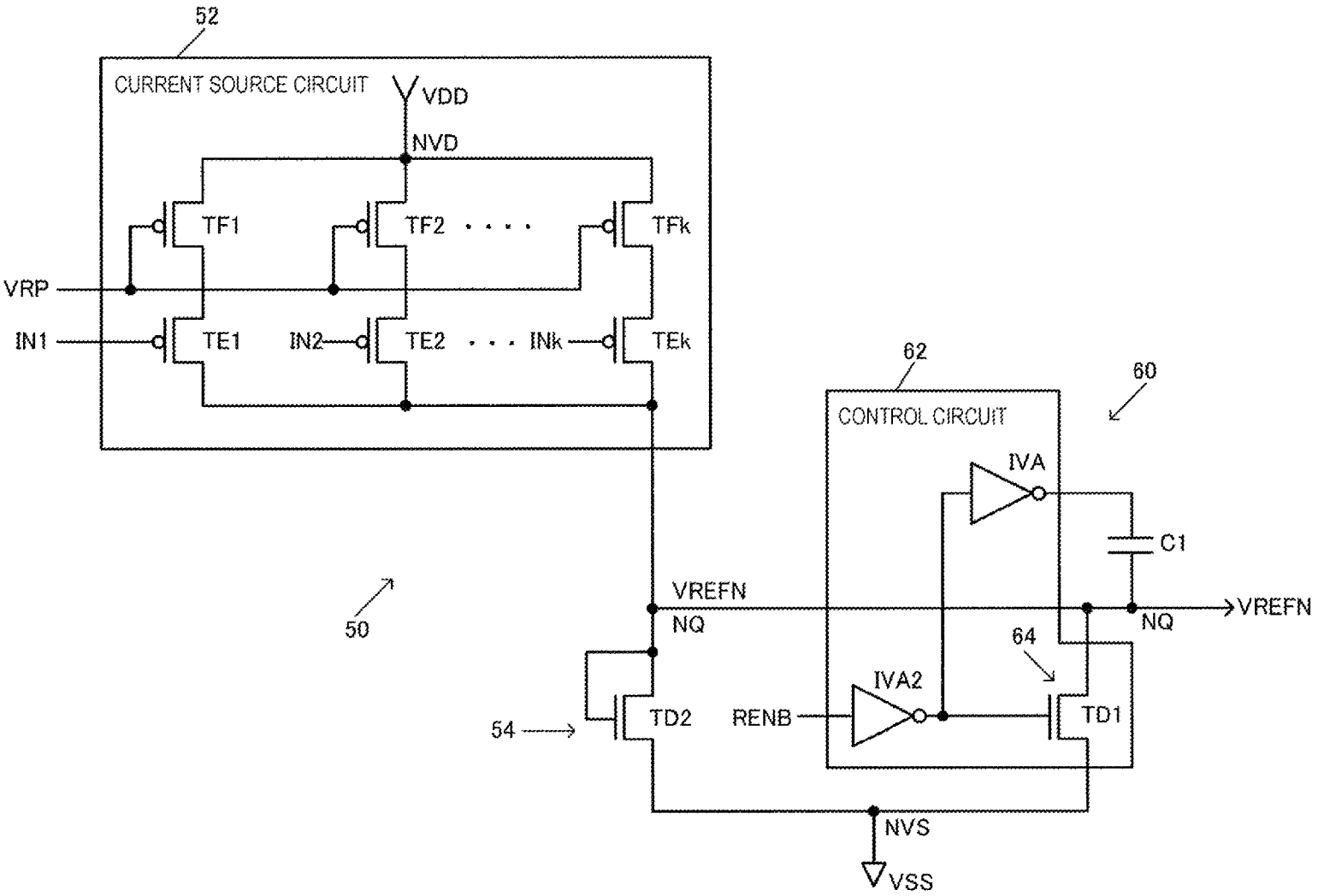
FIG. 4 illustrates examples of configurations of the reference voltage generation circuit and the setting circuit.

FIG. 4 illustrates another example of configurations of the reference voltage generation circuit 50 and the setting circuit 60. FIG. 3 is a circuit configuration example that generates the reference voltage VREFP supplied to the reference current sources 24-1 and 28-1 on a P side in FIG. 5 and FIG. 7, but FIG. 4 is a circuit configuration example that generates a reference voltage VREFN supplied to reference current sources 24-2 and 28-2 on an N side in FIG. 6 and FIG. 7.

In FIG. 3, the first power source and the second power source are VDD and VSS, respectively, but in FIG. 4, the first power source and the second power source are VSS and VDD, respectively. Further, in FIG. 3, the first voltage and the second voltage are at the H level and the L level, respectively, but in FIG. 4, the first voltage and the second voltage are at the L level and the H level, respectively.

Figure 6:
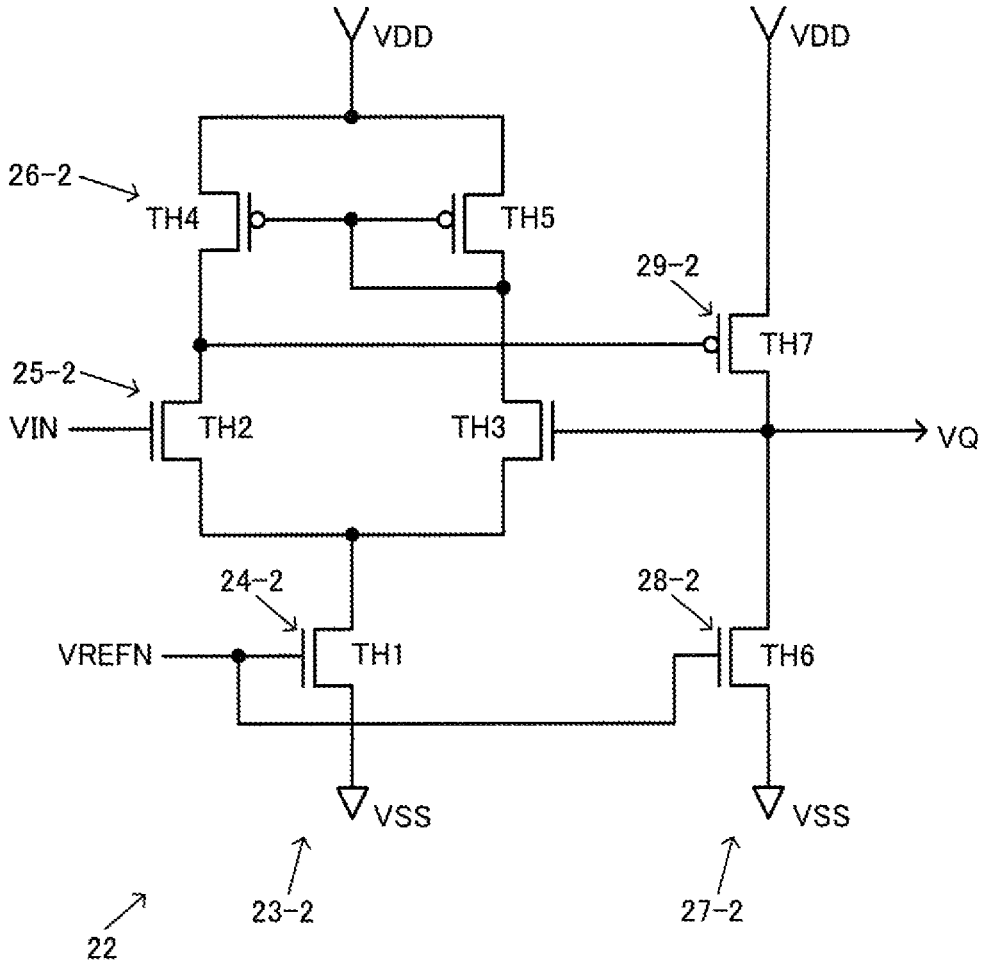
FIG. 6 illustrates an example of a configuration of an amplifier circuit.

Specifically in FIG. 4, the control circuit 62, by controlling the voltage of the other end of the capacitor C1, changes the voltage of the output node NQ from the L level that turns the reference current of the reference current sources 24-2 and 28-2 on the N side in FIG. 6 and FIG. 7 off toward the reference voltage VREFN. For example, the control circuit 62, when the enable signal RENB is at the L level, sets the one end and the other end of the capacitor C1 to the L level being the first voltage. Additionally, the control circuit 62, when the enable signal RENB is at the H level, sets the other end of the capacitor C1 to the H level being the second voltage.

Additionally in FIG. 4, the control circuit 62 includes, the switch 64 having the one end connected with the output node NQ, and another end connected with the node NVS of VSS being the first power source, and the inverter IVA and an inverter IVA2. Additionally, when the enable signal RENB is at the L level, the inverter IVA2 outputs a signal at the H level to turn the switch 64 on. The switch 64 is configured with an N-type transistor TD1, and the signal at the H level is inputted from the inverter IVA2 to a gate of the transistor TD1, to turn the transistor TD1 on. Further, the inverter IVA that received the signal at the H level from the inverter IVA2 outputs a signal at the L level being the voltage level of VSS to the other end of the capacitor C1. On the other hand, when the enable signal RENB is at the H level, the inverter IVA2 outputs a signal at the L level to turn the switch 64 configured with the N-type transistor TD1 off. Further, the inverter IVA that received the signal at the L level from the inverter IVA2 outputs a signal at the H level being the voltage level of VDD to the other end of the capacitor C1.

Also in FIG. 4, the current source circuit 52, having the one end connected with the output node NQ, and another end connected with the node NVD of VDD being the second power source, makes a current set based on current setting signals IN1 to INk flow between the node NVD and the output node NQ. The current voltage conversion circuit 54 having one end connected with the output node NQ, and another end connected with the node NVS of VSS being the first power source, converts the current made to flow by the current source circuit 52 to the reference voltage VREFN. Specifically, the current source circuit 52 is configured with a plurality of P-type transistors TE1 to TEk and a plurality of P-type transistors TF1 to TFk. Respective gates of the transistors TE1 to TEk are supplied with current setting signals IN1 to INk. A gate of each of the transistors TF1 to TFk is supplied with a reference voltage VRP for the P-type transistor. The current voltage conversion circuit 54 is configured with an N-type transistor TD2 provided between the node NVS of VSS and the output node NQ. In the transistor TD2, a source is connected with the node NVS, and a gate and a drain are connected with the output node NQ. By using this circuit in FIG. 4, the reference voltage VREFN supplied to the reference current sources 24-2 and 28-2 on the N side in FIG. 6 and FIG. 7 can be generated.

Note that, also in FIG. 4, similar to FIG. 3, respective sizes of the transistors TF2, TF3, TF4, . . . , TFk are set to two times, four times, eight times, . . . , $2^{k-1}$ times a size of the transistor TF1, respectively. Additionally, as the current flowing in the current source circuit 52 increases, the reference voltage VREFN increases, and a voltage difference VREFN-VSS increases. In response to the voltage difference VREFN-VSS increasing, the driving capability of the amplifier circuit 22 is enhanced. Thus, in an inspection process and an adjustment process before product shipment of the display driver 10, in order to set the amplifier circuit 22 to desired driving capability, respective set values of the current setting signals IN1 to INk are determined, and are stored in a set value storage unit such as a fuse circuit or a non-volatile memory.

FIG. 5, FIG. 6, and FIG. 7 illustrate various configuration examples of the amplifier circuit 22. The amplifier circuit 22 includes the reference current source 24 (24-1, 24-2), a differential pair circuit 25 (25-1, 25-2) connected with the reference current source 24 and including a differential pair transistor, and a current mirror circuit (26-1, 26-2) connected with the differential pair circuit 25.

The amplifier circuit 22 in FIG. 5 includes a differential unit 23-1 and an output unit 27-1. The differential unit 23-1 includes the reference current source 24-1 configured with the P-type transistor TG1, and the differential pair circuit 25-1 configured with transistors TG2, TG3 of a P-type differential pair, and the current mirror circuit 26-1 configured with N-type transistors TG4, TG5. The output unit 27-1 includes the reference current source 28-1 configured with the P-type transistor TG6, and a driving unit 29-1 configured with an N-type transistor TG7. A gate of the transistor TG2 configuring the differential pair is inputted with an input signal VIN, and a gate of the transistor TG3 configuring the differential pair is inputted with an output signal VQ of the output unit 27-1. As described above, the amplifier circuit 22 in FIG. 5 is configured as a circuit with the voltage follower connection. Note that the output signal VQ is a signal of the data voltage VD in FIG. 1.

The amplifier circuit 22 in FIG. 6 includes a differential unit 23-2 and an output unit 27-2. The differential unit 23-2 includes the reference current source 24-2 configured with an N-type transistor TH1, and the differential pair circuit 25-2 configured with transistors TH2, TH3 of an N-type differential pair, and the current mirror circuit 26-2 configured with P-type transistors TH4, TH5. The output unit 27-2 includes the reference current source 28-2 configured with an N-type transistor TH6, and a driving unit 29-2 configured with a P-type transistors TH7. A gate of the transistor TH2 is inputted with the input signal VIN, and a gate of the transistor TH3 is inputted with the output signal VQ of the output unit 27-2. As described above, the amplifier circuit 22 in FIG. 6 is configured as a circuit with the voltage follower connection.

The amplifier circuit 22 in FIG. 7 includes the differential unit 23-1 with a similar configuration to that in FIG. 5, the differential unit 23-2 with a similar configuration to that in FIG. 6, and an output unit 27. The output unit 27 is configured with the transistors TG7 and TH7 to be the driving units 29-1 and 29-2, respectively. Additionally, a gate of the transistor TG2 of the differential unit 23-1 and a gate of the transistor TH2 of the differential unit 23-2 are inputted with the input signal VIN. A gate of the transistor TG3 of the differential unit 23-1 and a gate of the transistor TH3 of the differential unit 23-2 are inputted with the output signal VQ of the output unit 27. Additionally, an output signal DFQ1 of the differential unit 23-1 is inputted to a gate of the transistor TG7 of the output unit 27, and an output signal DFQ2 of the differential unit 23-2 is inputted to a gate of the transistor TH7 of the output unit 27. According to the amplifier circuit 22 in the configuration in FIG. 7, an amplitude range of the output signal VQ can be secured sufficiently compared to FIG. 5 and FIG. 6.

Figure 8:
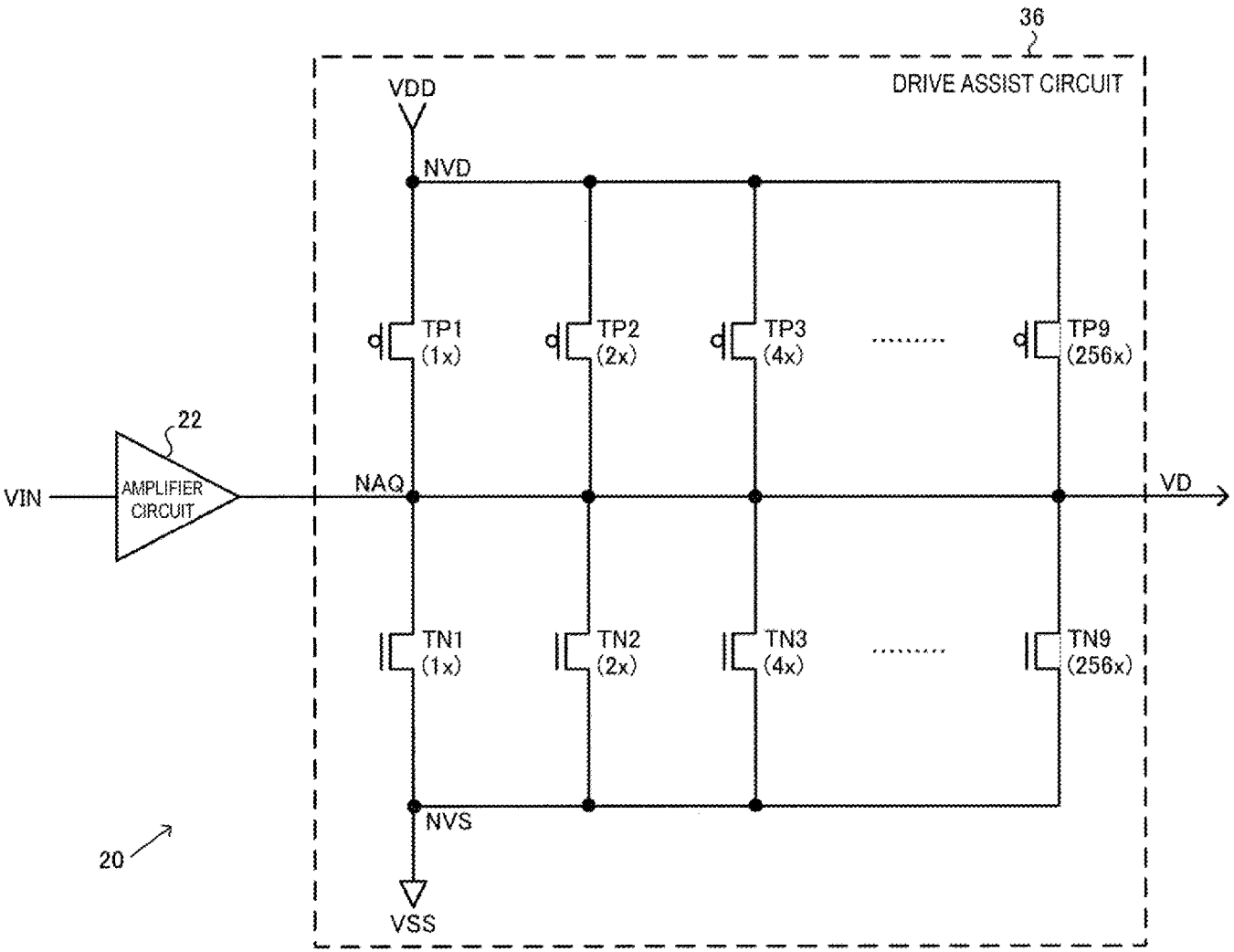
FIG. 8 illustrates a detailed example of a configuration of a driving circuit.

FIG. 8 illustrates a detailed example of a configuration of the driving circuit 20. The driving circuit 20 includes the amplifier circuit 22 and a drive assist circuit 36. The amplifier circuit 22 performs signal amplification on an output voltage of the D/A converter circuit 30 (DAC1 to DACn) in FIG. 2. The drive assist circuit 36 is a circuit provided at an output node NAQ of the amplifier circuit 22, and assists driving of the amplifier circuit 22. The drive assist circuit 36, for example, with drive assist ability set by an unillustrated operational circuit, performs preliminary driving before driving by the amplifier circuit 22. The drive assist circuit 36 enables high drive with higher driving capability than that of driving by the amplifier circuit 22. That is, the drive assist by the drive assist circuit 36 enables, before the driving by the amplifier circuit 22, the preliminary driving of the data voltage VD to bring to a voltage close to a target voltage, and thus settling time to the target voltage can be shortened. Note that in FIG. 2, the drive assist circuit 36 is provided on the output node of each of the amplifier circuits AM1 to AMn in FIG. 8.

The drive assist circuit 36 includes a plurality of P-type transistors TP1 to TP9 and a plurality of N-type transistors TN1 to TN9. The transistors TP1 to TP9 are provided between the node NVD of VDD and the output node NAQ of the amplifier circuit 22 in parallel. The transistors TN1 to TN9 are provided between the output node NAQ and the node NVS of VSS in parallel. Respective sizes (W/L) of the transistors TP2, TP3, . . . , TP9 are set to two times, four times, . . . , 256 times a size of the transistor TP1. Respective sizes of the transistors TN2, TN3, . . . , TN9 are set to two times, four times, . . . , 256 times a size of the transistor TN1.

Figure 9:
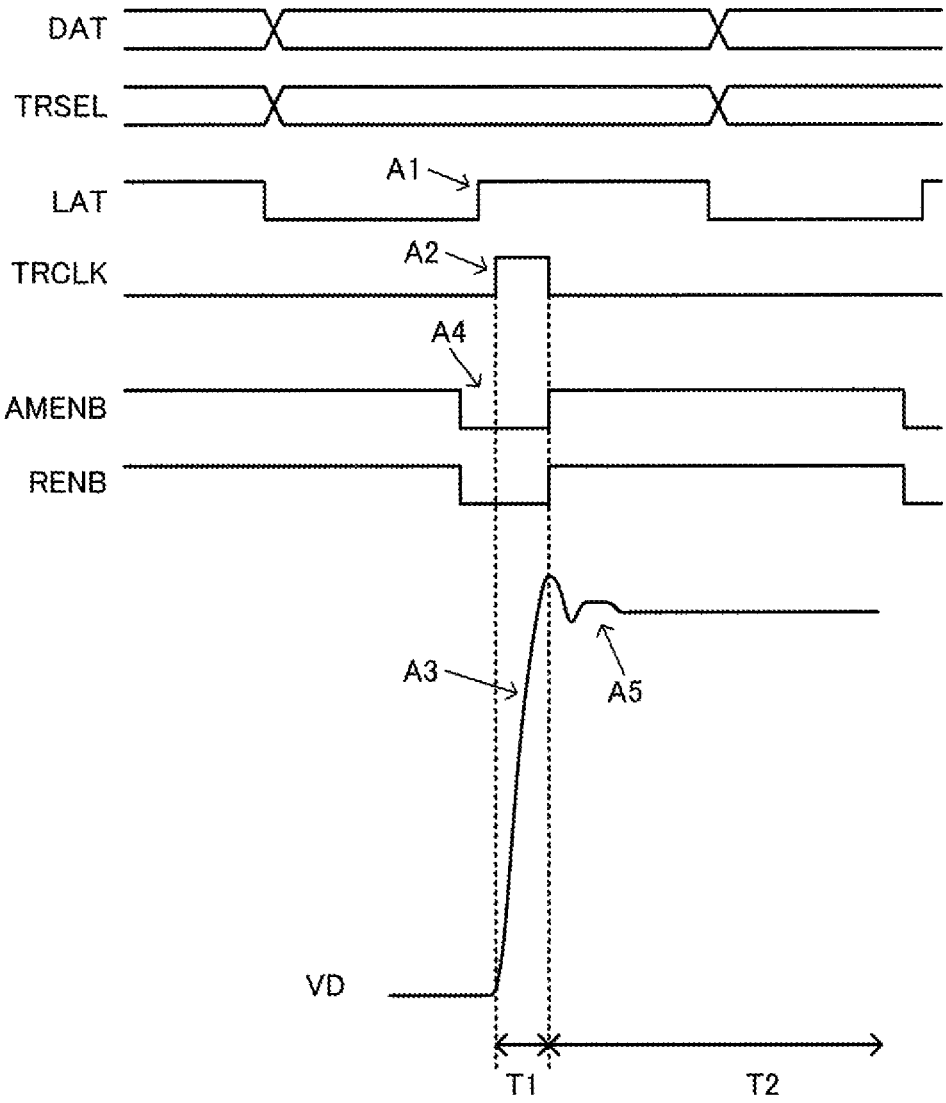
FIG. 9 illustrates an example of a signal waveform when a drive assist circuit performing high drive.

FIG. 9 illustrates an example of a signal waveform when performing the high drive by the drive assist circuit 36. DAT is display data, and TRSEL is data for setting drive assist ability. Each gate of the transistors TP1 to TP9, TN1 to TN9 in FIG. 8 is inputted with a setting signal for the drive assist ability based on the data TRSEL, and is set to on or off. In the preliminary driving by the drive assist circuit 36, respective currents made to flow by the transistors TP1 to TP9, TN1 to TN9 charge parasitic capacitance and pixel capacitance of data lines. Specifically, based on tone change information corresponding to a change amount of a tone of current display data with respect to the tone of previous display data, a current made to flow by the preliminary driving of the drive assist circuit 36 is set. That is, based on the tone change information, the data TRSEL for setting the drive assist ability is set. Specifically, the data TRSEL for setting the drive assist ability is set such that as a tone change amount increases a current made to flow by the preliminary driving of the drive assist circuit 36 increases.

LAT is a latch clock of data. At timing A1 in FIG. 9, the data DAT and TRSEL are latched. TRCLK is a clock for setting a duration of the high drive by the drive assist circuit 36. As denoted by A2, in a duration in which TRCLK is at the H level, the high drive by the drive assist circuit 36 is performed. Accordingly, in a first driving duration T1, the high drive denoted by A3 is performed. In this first driving duration T1 of the high drive, as denoted by A4, an enable signal AMENB for an operation of the amplifier circuit 22 and the enable signal RENB for the reference voltage output of the reference voltage generation circuit 50 are at the L level, and become inactive. Further, in a second driving duration T2 after the first driving duration T1, as denoted by A5, normal driving is performed by the amplifier circuit 22.

In this way, in the exemplary embodiment, the driving circuit 20, in the first driving duration T1, drives the data line DL with the higher driving capability than the driving capability of the amplifier circuit 22. For example, the high drive of the data line DL is performed by the drive assist circuit 36. Additionally, in the second driving duration T2 after the first driving duration T1, the data voltage VD is outputted to the data line DL by the amplifier circuit 22. That is, the normal driving is performed by the amplifier circuit 22. In addition, the setting circuit 60, in the first driving duration T1, sets the voltage of the output node NQ of the reference voltage generation circuit 50 to, for example, the first voltage being the H level or the L level. This turns the reference current of the amplifier circuit 22 off, and power saving is achieved. In addition, the setting circuit 60, in the second driving duration T2, sets the voltage of the output node NQ to the reference voltage VREF. The reference voltage VREF is the reference voltage VREFP or VREFN. For example, the control circuit 62, by controlling the voltage of the other end of the capacitor C1, changes the voltage of the output node NQ from the first voltage toward the reference voltage VREF, and subsequently, the voltage of output node NQ is transited to the reference voltage VREF by the reference voltage generation circuit 50.

As described above, by performing the high drive by the drive assist circuit 36 or the like in the first driving duration T1, as denoted by A3 in FIG. 9, the data voltage VD can be brought closer to the target voltage. Accordingly, the settling time to the target voltage can be shortened, the high speed driving of the display driver 10 is enabled, and driving the electro-optical panel 200 with high-definition such as 4K resolution is also enabled. Further, in the first driving duration T1, as denoted by A4, since the enable signal RENB is at the L level, power is saved. That is, since the enable signal RENB is at the L level, the reference voltage output of the reference voltage generation circuit 50 turns off, the reference current of the amplifier circuit 22 turns off and thus power is saved. Further, in the second driving duration T2 after the first driving duration T1, since the enable signal RENB is at the H level, as denoted by A5, the normal driving by the amplifier circuit 22 is enabled. Additionally, according to the exemplary embodiment, when the enable signal RENB changes from the L level to the H level, the reference voltage output of the reference voltage generation circuit 50 also switches from off to on at high speed. That is, the first voltage that turns the reference current off changes to the reference voltage VREF at high speed. Accordingly, the reference current of the amplifier circuit 22 is switched from off to on at high speed, thus a situation in which the second driving duration T2 is shortened can be prevented effectively. Accordingly, the high speed driving of the display driver 10 is enabled, and driving the electro-optical panel 200 with high-definition such as 4K resolution is enabled.

3. Second Example of Configuration

Figure 10:
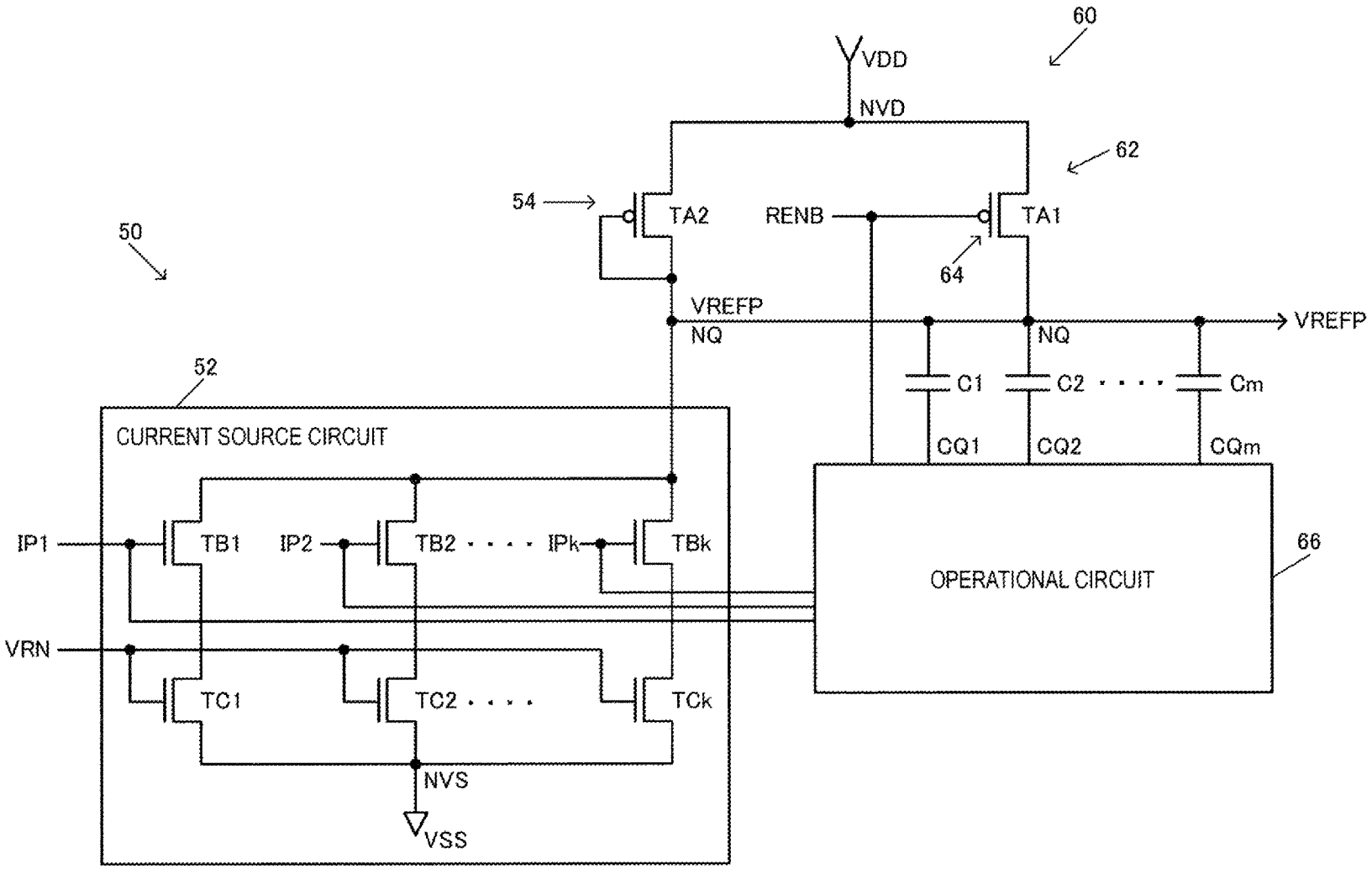
FIG. 10 illustrates a second example of a configuration of the exemplary embodiment.

FIG. 10 illustrates a second example of a configuration of the exemplary embodiment. In FIG. 10, a configuration of the setting circuit 60 differs from that in FIG. 3. Specifically, in FIG. 10, the setting circuit 60 includes capacitors C1 to Cm (first to m-th capacitors) in each of which one end is connected with the output node NQ, and the control circuit 62. The control circuit 62, by controlling a voltage of another end of each of the capacitors C1 to Cm, based on the enable signal RENB of the reference voltage VREFP, changes the voltage of the output node NQ from the first voltage (VDD) that turns the reference current off toward the reference voltage VREFP. The reference voltage generation circuit 50 includes the current source circuit 52 and the current voltage conversion circuit 54 that have similar configurations to those in FIG. 3. The current source circuit 52 makes a current set based on the current setting signals IP1 to IPk flow between the output node NQ and the node NVS of VSS. The current voltage conversion circuit 54 converts the current made to flow by the current source circuit 52 to the reference voltage VREFP.

Further, the control circuit 62 controls the voltage of the other end of each of one or more capacitors selected based on the current setting signals IP1 to IPk, among the capacitors C1 to Cm. For example, the control circuit 62 includes the P-type transistor TA1 whose gate is inputted with the enable signal RENB, and an operational circuit 66. The operational circuit 66 is inputted with the current setting signals IP1 to IPk and the enable signal RENB. The operational circuit 66 performs arithmetic processing explained in FIG. 12 to FIG. 15 described later. Further, the operational circuit 66 outputs control signals CQ1 to CQm, and controls to change the voltage of the other end of each of one or more capacitors selected based on the current setting signals IP1 to IPk among the capacitors C1 to Cm.

Figure 11:
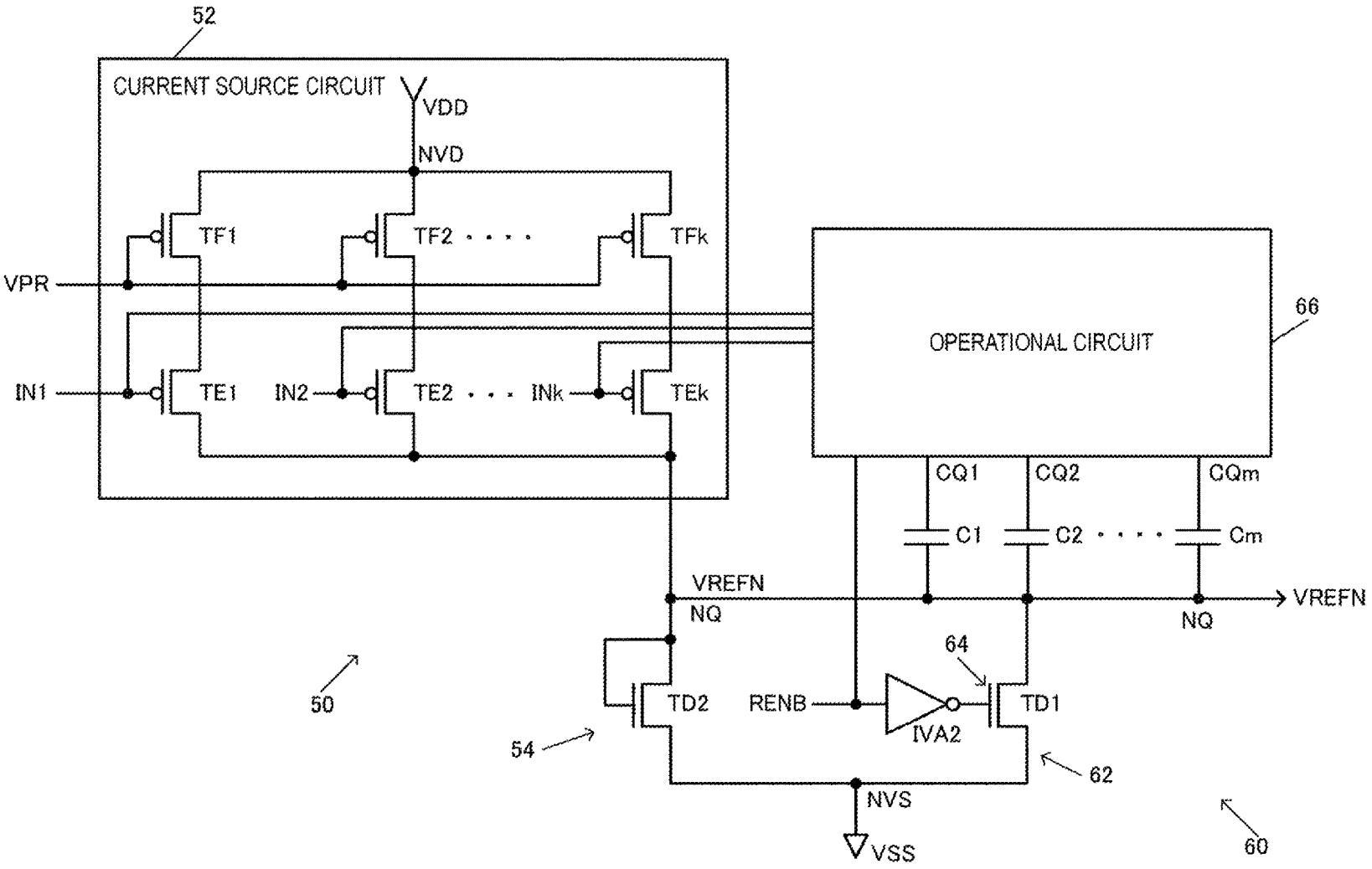
FIG. 11 illustrates the second example of the configuration of the exemplary embodiment.

FIG. 11 is a diagram illustrating the second example of the configuration of the exemplary embodiment corresponding to the configuration in FIG. 4. Also in FIG. 11, a configuration of the setting circuit 60 differs from that in FIG. 4. In FIG. 11, the setting circuit 60 includes the capacitors C1 to Cm and the control circuit 62. Additionally, the reference voltage generation circuit 50 includes the current source circuit 52 and the current voltage conversion circuit 54 that have similar configurations to those in FIG. 4. Further, the control circuit 62 controls the voltage of the other end of each of one or more capacitors selected based on the current setting signals IN1 to INk, among the capacitors C1 to Cm. For example, the control circuit 62 includes the N-type transistor TD1, the operational circuit 66, and the inverter IVA2 for outputting an inverted signal of the enable signal RENB to a gate of the transistor TD1. The operational circuit 66 is inputted with the current setting signals IN1 to INk and the enable signal RENB. Further, the operational circuit 66 outputs the control signals CQ1 to CQm, and controls the voltage of the other end of each of one or more capacitors selected based on the current setting signals IN1 to INk among the capacitors C1 to Cm.

As described above, in FIG. 10 and FIG. 11, the voltage of the other end of each of one or more capacitors selected based on the current setting signals IP1 to IPk or IN1 to INk is controlled. Here, the one or more capacitors selected based on the current setting signals IP1 to IPk or IN1 to INk are denoted as a capacitor CSL for convenience of explanation. This capacitor CSL is a substantial capacitor for the capacitors C1 to Cm. Additionally, capacitance of the capacitor CSL is denoted as CV, and parasitic capacitance at the output node NQ is denoted as CP.

When the capacitors C1 to Cm (CSL) are used to change the voltage of the output node NQ, magnitude of voltage change is determined by a capacitance ratio CRT=CV/CP of the capacitance CV with respect to the parasitic capacitance CP. As the capacitance ratio CRT increases, the voltage change of the output node NQ increases. Accordingly, in order to bring the voltage of the output node NQ closer to the reference voltage VREFP or VREFN being a target voltage, the capacitance CV needs to be set appropriately. For example, in FIG. 10, a setting is made such that as a voltage difference VDD-VREFP increases the capacitance CV increases. In FIG. 11, a setting is made such that as a voltage difference VREFN-VSS increases the capacitance CV increases. The operational circuit 66 performs arithmetic processing for the above setting of the capacitance CV.

Figure 12:
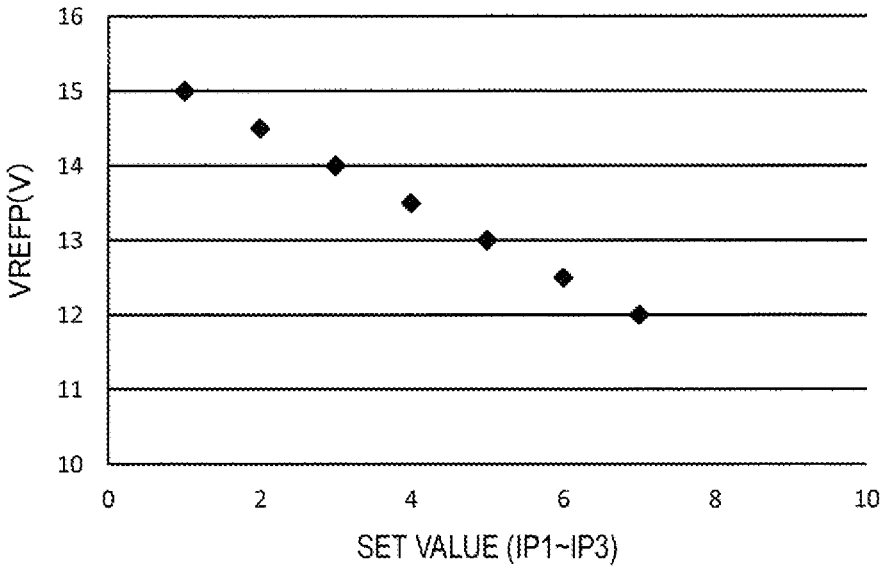
FIG. 12 illustrates an explanatory diagram of an operational circuit.
Figure 13:
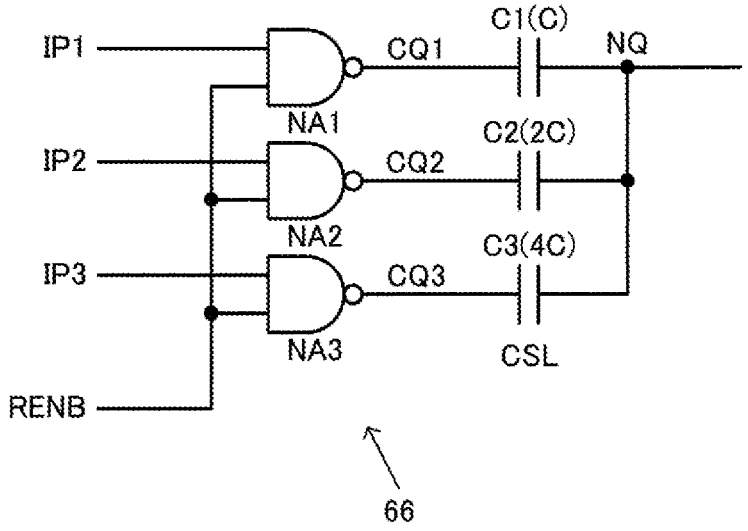
FIG. 13 illustrates an example of a configuration of the operational circuit.

Next, by using FIG. 12 and FIG. 13, the operational circuit 66 used in FIG. 10 will be described. Here, a case in which k=3, m=3 in FIG. 10 is taken as an example for explanation. In FIG. 12, a horizontal axis indicates set values by the current setting signals IP1, IP2, and IP3, and a vertical axis indicates the reference voltage VREFP. Additionally, FIG. 13 is an example of a configuration of the operational circuit 66 in FIG. 10. This operational circuit 66 is configured with NAND circuits NA1, NA2, and NA3. The control signals CQ1, CQ2, and CQ3 outputted from the operational circuit 66 are supplied to the other ends of the capacitors C1, C2, and C3, respectively. When capacitance of the capacitor C1 is C, capacitance of the capacitors C2 and C3 are 2C and 4C, respectively.

When voltage levels of the current setting signals IP1, IP2, and IP3 are at the H level, the L level, and the L level, respectively, the set value in FIG. 12 is 1. In this case, the transistor TB1 in FIG. 10 turns on, and the other transistors TB2 and TB3 turn off. This makes only a current flowing in the transistor TC1 flow in the transistor TA2 being the current voltage conversion circuit 54. Accordingly, the reference voltage VREFP becomes a voltage close to VDD, and the voltage difference VDD-VREFP decreases.

On the other hand, in FIG. 13, when the enable signal RENB is at the L level, all the control signals CQ1, CQ2, and CQ3 are at the H level, and the control signals CQ1, CQ2, and CQ3 at the H level are outputted to the other ends of the capacitors C1, C2, and C3, respectively.

Next, in response to the enable signal RENB changing from the L level to the H level, the current setting signals IP1, IP2, and IP3 are at the H level, the L level, and the L level, respectively, thus the control signals CQ1, CQ2, and CQ3 are at the L level, the H level, and the H level, respectively. That is, only the control signal CQ1 changes from the H level to the L level, and the control signals CQ2 and CQ3 remain at the H level. That is, the voltage of the other end of the capacitor C1 selected based on the current setting signals IP1, IP2, and IP3, among the capacitors C1, C2, and C3 (the first to the m-th capacitors) is controlled to change from the H level to the L level. In this case, the substantial capacitor CSL for the capacitors C1, C2, and C3 is the capacitor C1, and capacitance of the capacitor is CV=C. Accordingly, the above-described capacitance ratio is CRT=CV/CP=C/CP, that is, CRT becomes a small value. That is, small capacitance CV=C is set corresponding to the small voltage difference VDD-VREFP.

When all the voltage levels of the current setting signals IP1, IP2, and IP3 are at the H level, the set value in FIG. 12 is 7. In this case, all the transistor TB1 to TB3 in FIG. 10 turn on, and currents of all the transistors TC1 to TC3 flow in the transistor TA2, thus the voltage difference VDD-VREFP increases.

Additionally, in response to the enable signal RENB changing from the L level to the H level, all the current setting signals IP1, IP2, and IP3 are at the H level, thus all the control signals CQ1, CQ2, and CQ3 change from the H level to the L level. Accordingly, all the capacitors C1, C2, and C3 are in a state of being selected based on the current setting signals IP1, IP2, and IP3, and the voltage of each other end is controlled to change from the H level to the L level. In this case, the capacitance of the substantial capacitor CSL is CV=C+2C+4C=7C, and large capacitance CV=7C is set corresponding to the large voltage difference VDD-VREFP.

As described above, according to the operational circuit 66 in FIG. 13, the capacitor corresponding to the voltage difference VDD-VREFP is selected among the capacitors C1 to C3, and the voltage of the other end of the capacitor is controlled. Accordingly, when the voltage difference VDD-VREFP is small, voltage change in the output node NQ can be decreased, and when the voltage difference VDD-VREFP is large, the voltage change in the output node NQ can be increased. As a result, in response to the reference voltage output of the reference voltage generation circuit 50 being switched from off to on, optimal voltage control for bringing the voltage of the output node NQ closer to the reference voltage VREFP being the target voltage can be achieved.

Figure 14:
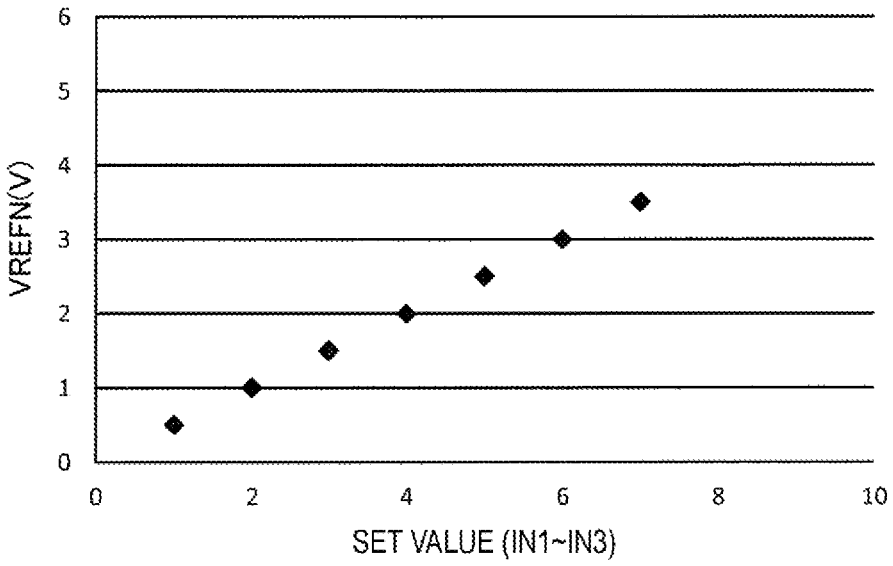
FIG. 14 illustrates an explanatory diagram of the operational circuit.
Figure 15:
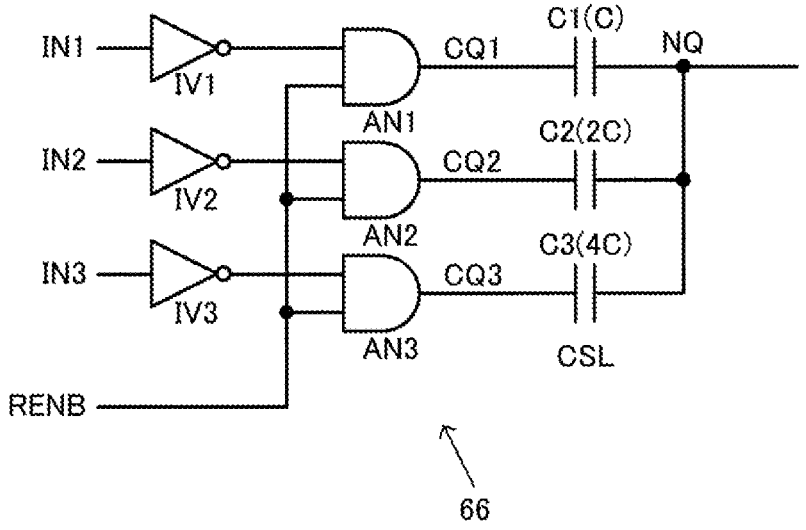
FIG. 15 illustrates an example of a configuration of the operational circuit.

Next, by using FIG. 14 and FIG. 15, the operational circuit 66 used in FIG. 11 will be described. In FIG. 14, a horizontal axis indicates set values by the current setting signals IN1, IN2, and IN3, and a vertical axis indicates the reference voltage VREFN. Further, FIG. 15 is an example of a configuration of the operational circuit 66 in FIG. 11, and the operational circuit 66 is configured with AND circuits AN1, AN2, AN3, and inverters IV1, IV2, and IV3.

When respective voltage levels of the current setting signals IN1, IN2, and IN3 are at the L level, the H level, and the H level, the set value in FIG. 14 is 1. In this case, the transistor TE1 in FIG. 11 turns on, and only a current flowing in the transistor TE1 flows in the transistor TD2. Accordingly, the reference voltage VREFN becomes a voltage close to VSS, and the voltage difference VREFN-VSS decreases.

On the other hand, in FIG. 14, when the enable signal RENB is at the L level, the control signals CQ1, CQ2, and CQ3 at the L level are outputted to the respective other ends of the capacitors C1, C2, and C3. Additionally, in response to the enable signal RENB changing from the L level to the H level, since the current setting signals IN1, IN2, and IN3 are at the L level, the H level, and the H level, respectively, thus the only the control signal CQ1 changes from the L level to the H level, and the control signals CQ2 and CQ3 remain at the L level. That is, the voltage of the other end of the capacitor C1 selected based on the current setting signals IN1, IN2, and IN3, among the capacitors C1, C2, and C3 is controlled to change from the L level to the H level. In this case, the substantial capacitor CSL is the capacitor C1, and capacitance is CV=C, that is, the capacitance becomes a small value. That is, small capacitance CV=C is set corresponding to the small voltage difference VREFN-VSS.

When all the voltage levels of the current setting signals IN1, IN2, and IN3 are at the L level, the set value in FIG. 14 is 7. In this case, all the transistor TE1 to TE3 turn on, and currents of all the transistors TF1 to TF3 flow in the transistor TD2, thus the voltage difference VREFN-VSS increases.

Additionally, in response to the enable signal RENB changing from the L level to the H level, all the current setting signals IN1, IN2, and IN3 are at the L level, thus all the control signals CQ1, CQ2, and CQ3 change from the L level to the H level. Accordingly, all the capacitors C1, C2, and C3 are in a state of being selected based on the current setting signals IN1, IN2, and IN3, and the voltage of each other end is controlled to change from the L level to the H level. In this case, the capacitance of the substantial capacitor CSL is CV=C+2C+4C=7C, and large capacitance CV=7C is set corresponding to the large voltage difference VREFN-VSS.

As described above, according to the operational circuit 66 in FIG. 15, the capacitor corresponding to the voltage difference VREFN-VSS is selected among the capacitors C1 to C3, and the voltage of the other end of the capacitor is controlled. Accordingly, when the voltage difference VREFN-VSS is small, voltage change in the output node NQ can be decreased, and when the voltage difference VREFN-VSS is large, the voltage change in the output node NQ can be increased. As a result, in response to the reference voltage output of the reference voltage generation circuit 50 being turned from off to on, optimal voltage control for bringing the voltage of the output node NQ closer to the reference voltage VREFN being the target voltage can be achieved.

Note that, the configuration of the operational circuit 66 is not limited to the configurations described in FIG. 12 to FIG. 15, and various modifications can be achieved. For example, a current IDS flowing in an MOS transistor has a current value corresponding to a square of a voltage Vgs-Vth, but in an area close to a source voltage, the current IDS and the voltage Vgs-Vth can be approximated to have linear relation. Accordingly, in FIG. 12, the set values of the current setting signals IP1 to IP3 and the reference voltage VREFP are set to have linear relation, and in FIG. 14, the set values of the current setting signals IN1 to IN3 and the reference voltage VREFN are set to have linear relation. However, a modification in which the operational circuit 66 is configured such that the set values and the reference voltage VREFP or VREFN have more precise relation corresponding to current voltage characteristics of the MOS transistor can be achieved.

4. Circuit Device

Figure 16:
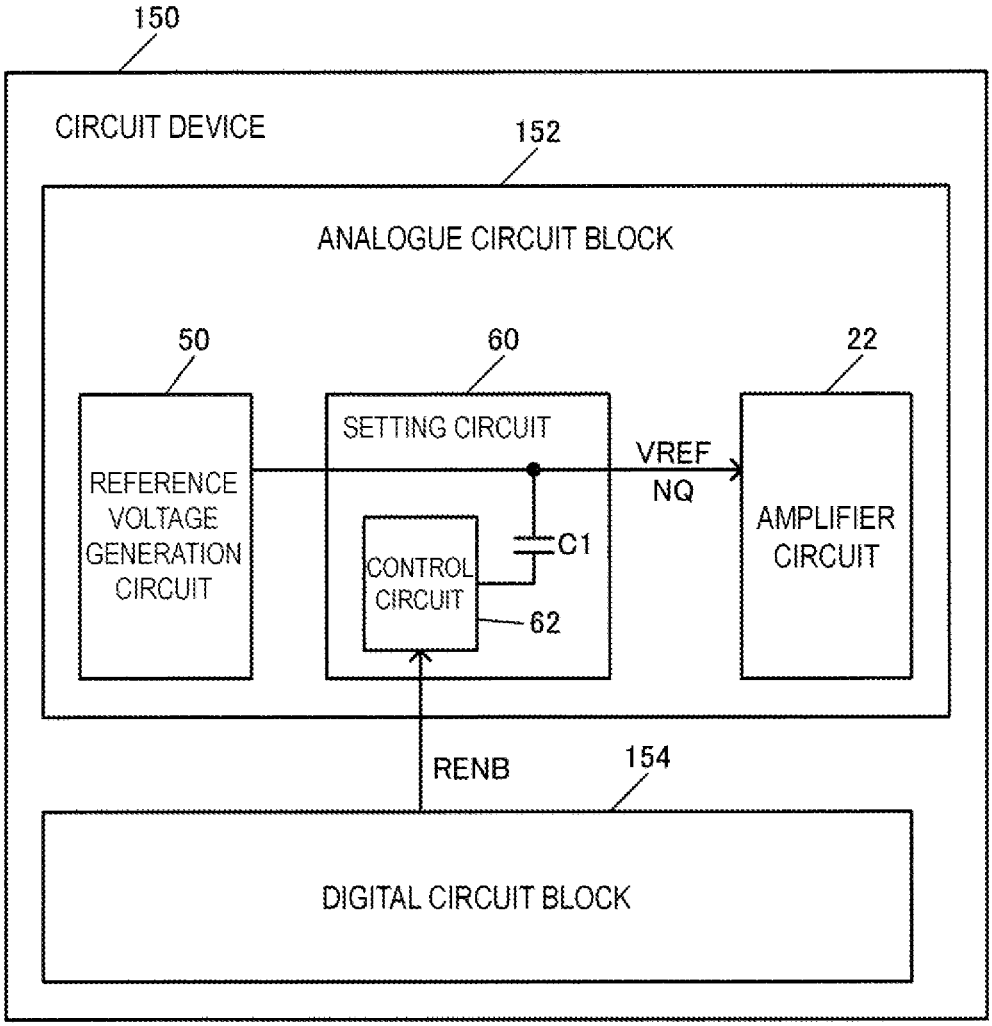
FIG. 16 illustrates an example of a configuration of a circuit device in the exemplary embodiment.

Hereinbefore, the case in which the display driver 10 of the exemplary embodiment is a display driver was taken as the example for explanation, but the display driver 10 in the exemplary embodiment may be a circuit device other than the display driver. FIG. 16 illustrates an example of a configuration of the circuit device 150 (IC) in the exemplary embodiment.

The circuit device 150 in FIG. 16 includes an analogue circuit block 152 and a digital circuit block 154. The digital circuit block 154 is implemented by a circuit with automatic placement and routing such as a gate array, for example. Additionally, the analogue circuit block 152 is provided with the amplifier circuit 22, the reference voltage generation circuit 50, and the setting circuit 60 in the exemplary embodiment. The reference voltage generation circuit 50 generates the reference voltage VREF and outputs to the output node NQ. In addition, the setting circuit 60 includes the capacitor C1 having the one end connected with the output node NQ, and the control circuit 62 that controls the voltage of the other end of the capacitor C1 based on the enable signal RENB to change the voltage of the output node NQ toward the reference voltage VREF.

As the circuit device 150, there are various circuit devices other than the display driver 10, such as sensor devices such as a gyro sensor and an acceleration sensor, an oscillator, a communication interface such as USB, or a motor driver for a robot or a printer, and the like.

5. Electronic Apparatus, Projector

Figure 17:
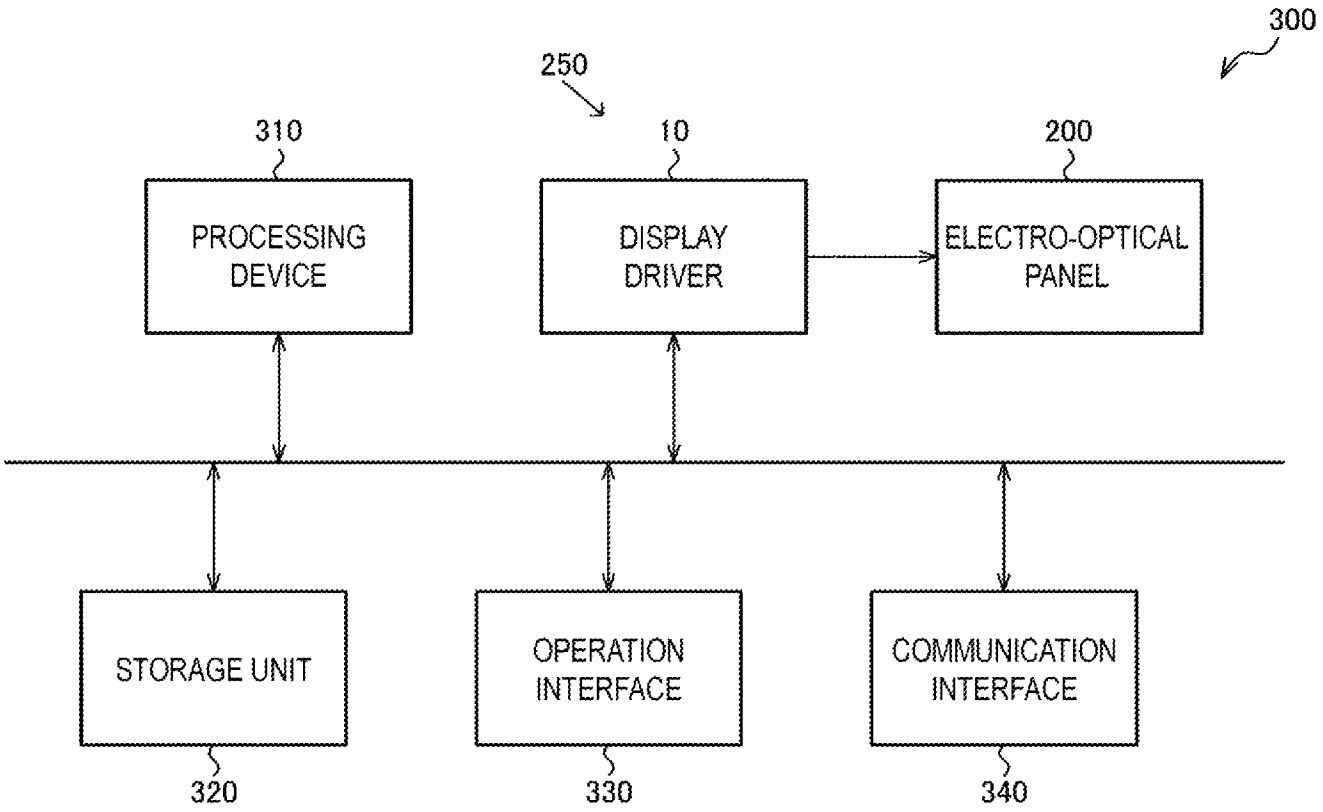
FIG. 17 illustrates an example of a configuration of an electronic apparatus in the exemplary embodiment.

FIG. 17 illustrates an example of a configuration of an electronic apparatus 300 including the display driver 10 of the exemplary embodiment. The electronic apparatus 300 includes the display driver 10, the electro-optical panel 200, a processing device 310, a storage unit 320, an operation interface 330, and a communication interface 340. The display driver 10 and the electro-optical panel 200 configure the electro-optical device 250. Various types of electronic apparatuses, such as a projector, a head-mounted display, a mobile information terminal, a vehicle-mounted device (e.g., a meter panel, a car navigation system, or the like), a mobile game console, a robot, or an information processing device, exist as specific examples of the electronic apparatus 300.

The processing device 310 carries out control processing for the electronic apparatus 300, various types of signal processing, and the like. The processing device 310 can be realized by, for example, a processor such as a CPU or an MPU, an ASIC, or the like. The storage unit 320 stores data inputted from the operation interface 330 and the communication interface 340, or functions as a work memory for the processing device 310, for example. The storage unit 320 can be realized by, for example, semiconductor memory such as RAM or ROM, a magnetic storage device such as an HDD, an optical storage device such as a CD drive or a DVD drive, or the like. The operation interface 330 is a user interface for receiving various operations from a user. For example, the operation interface 330 can be realized by buttons, a mouse, a keyboard, a touch panel installed in the electro-optical panel 200, or the like. The communication interface unit 340 is an interface for communicating image data and control data. Communication processing performed by the communication interface 340 may be wired communication processing or wireless communication processing.

Note that when the electronic apparatus 300 is a projector, a projection unit including a light source and an optical system is further provided. The light source is realized by a lamp unit including a white light source such as a halogen lamp, for example. The optical system is realized by lenses, prisms, mirrors, or the like, for example. In a case where the electro-optical panel 200 is a transmissive type, light from the light source is incident on the electro-optical panel 200 via the optical system and the like, and the light transmitted by the electro-optical panel 200 is projected onto a screen. In a case where the electro-optical panel 200 is a reflective type, light from the light source is incident on the electro-optical panel 200 via the optical system and the like, and the light reflected by the electro-optical panel 200 is projected onto a screen.

Although some exemplary embodiments have been described in detail above, those skilled in the art will understand that many modified examples can be made without substantially departing from the novel matter and effects of the invention. All such modified examples are thus included in the scope of the invention. For example, terms in the descriptions or drawings given even once along with different terms having identical or broader meanings can be replaced with those different terms in all parts of the descriptions or drawings. All combinations of the exemplary embodiments and modified examples are also included within the scope of the invention. The configurations, the operations, and the like of the display driver, the electro-optical device, the electro-optical panel, circuit device, and the electronic apparatus are not limited to those described in the exemplary embodiments, and various modifications can be achieved.

The entire disclosure of Japanese Patent Application No. 2018-011416, filed Jan. 26, 2018 is expressly incorporated by reference herein.

What is claimed is:

1. A display driver, comprising:

a driving circuit including an amplifier circuit and configured to cause the amplifier circuit to output a data voltage corresponding to display data;

a reference voltage generation circuit configured to generate a reference voltage supplied to a reference current source of the amplifier circuit and output the reference voltage to an output node; and a setting circuit configured to set a voltage of the output node of the reference voltage generation circuit, the setting circuit including:

a capacitor having one end connected with the output node; and a control circuit configured to:

control a voltage of another end of the capacitor based on an enable signal, to change a voltage of the output node from a first voltage at which a reference current flowing in the reference current source is off, toward the reference voltage;

set the one end and the other end of the capacitor to the first voltage when the enable signal is inactive; and set the other end of the capacitor to a second voltage different from the first voltage when the enable signal is active.

2. The display driver according to claim 1, wherein the first voltage is a source voltage of a first power source, and the second voltage is a source voltage of a second power source, the control circuit includes a switch having one end connected with the output node, and another end connected with a node of the first power source, and an inverter configured to output an inverted signal of the enable signal to the other end of the capacitor, and when the enable signal is inactive, the switch is turned on and the inverter outputs a signal with a voltage level of the first power source to the other end of the capacitor, and when the enable signal is active, the switch is turned off, and the inverter outputs a signal with a voltage level of the second power source to the other end of the capacitor.

3. The display driver according to claim 1, wherein the first voltage is a source voltage of a first power source, and the second voltage is a source voltage of a second power source, and the reference voltage generation circuit includes a current source circuit, having one end connected with the output node, and another end connected with a node of the second power source, configured to make a current set based on a current setting signal flow between the output node and a node of the second power source, and a current voltage conversion circuit, having one end connected with the output node, and another end connected with a node of the first power source, configured to convert the current made to flow by the current source circuit to the reference voltage.

4. The display driver according to claim 1, wherein the amplifier circuit includes the reference current source, a differential pair circuit connected with the reference current source and including a differential pair transistor, and a current mirror circuit connected with the differential pair circuit.

5. An electro-optical device comprising:

the display driver according to claim 1; and an electro-optical panel driven by the display driver.

6. An electronic apparatus, comprising:

the display driver according to claim 1.

7. A circuit device, comprising:

a driving circuit including an amplifier circuit and configured to:

cause the amplifier circuit to output a data voltage corresponding to display data;

drive a data line with a higher driving capability than a driving capability of the amplifier circuit, in a first driving duration; and cause the amplifier circuit to output the data voltage to the data line in a second driving duration following the first driving duration;

a reference voltage generation circuit configured to generate a reference voltage supplied to a reference current source of the amplifier circuit and output the reference voltage to an output node, the reference voltage generation circuit including:

a current source circuit, having one end connected with the output node, and another end connected with a node of a second power source, configured to make a current set based on a current setting signal flow between the output node and a node of the second power source; and a current voltage conversion circuit, having one end connected with the output node, and another end connected with a node of a first power source, configured to convert the current made to flow by the current source circuit to the reference voltage; and a setting circuit configured to set a voltage of the output node to the first voltage in the first driving duration, and set the voltage of the output node to the reference voltage in the second driving duration, the setting circuit including:

first to m-th capacitors, each having one end that is connected with the output node;

a control circuit configured to control a voltage of another end of each of the first to the m-th capacitors based on an enable signal to change a voltage of the output node from a first voltage at which a reference current flowing in the reference current source is off, toward the reference voltage; and control a voltage of the other end of each of one or more capacitors selected based on the current setting signal among the first to the m-th capacitors.

8. A display driver, comprising:

a setting circuit including a capacitor having one end connected with an output node, the setting circuit being configured to:

output a first voltage to the output node and set the one end and another end of the capacitor to the first voltage, when an enable signal is inactive;

change a voltage of the output node from the first voltage toward a reference voltage when the enable signal changes from inactive to active; and set the voltage of the output node to the reference voltage and set the other end of the capacitor to a second voltage different from the first voltage, when the enable signal is active; and an amplifier circuit including a reference current source, wherein in the amplifier circuit, when a voltage of the output node is the first voltage, a reference current flowing in the reference current source is turned off, and the amplifier circuit is configured to output a data voltage corresponding to display data when the voltage of the output node is the reference voltage.

9. A circuit device, comprising:

a reference voltage generation circuit configured to generate a reference voltage and output the reference voltage to an output node; and a setting circuit configured to set a voltage of the output node of the reference voltage generation circuit, the setting circuit including:

a capacitor having one end connected with the output node; and a control circuit configured to:

control a voltage of another end of the capacitor based on an enable signal to change a voltage of the output node from a first voltage toward the reference voltage;

set the one end and the other end of the capacitor to the first voltage when the enable signal is inactive; and set the other end of the capacitor to a second voltage different from the first voltage when the enable signal is active.

* * * * *